US009952543B2

(12) United States Patent
Shigeoka

(10) Patent No.: US 9,952,543 B2
(45) Date of Patent: Apr. 24, 2018

(54) IMAGE-FORMING APPARATUS WITH INTERRUPT PRINTING FUNCTION

(71) Applicant: KYOCERA Document Solutions Inc., Osaka (JP)

(72) Inventor: Tatsuya Shigeoka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/482,753

(22) Filed: Apr. 8, 2017

(65) Prior Publication Data

US 2017/0293247 A1 Oct. 12, 2017

(30) Foreign Application Priority Data

Apr. 8, 2016 (JP) ..... 2016-077925

(51) Int. Cl.
*G03G 15/00* (2006.01)
*G03G 15/23* (2006.01)

(52) U.S. Cl.
CPC ..... *G03G 15/5012* (2013.01); *G03G 15/50* (2013.01); *G03G 15/5083* (2013.01); *G03G 15/234* (2013.01); *G03G 2215/00126* (2013.01)

(58) Field of Classification Search
CPC ..... G03G 15/5012
See application file for complete search history.

(56) References Cited

U.S. PATENT DOCUMENTS 5,815,770 A * 9/1998 Ogino ..... G03G 15/5012 399/410
6,483,999 B1 * 11/2002 Andersen ..... H04N 1/0035 399/87
8,433,215 B2 * 4/2013 Tsujita ..... G03G 15/2039 399/82
2011/0236105 A1 9/2011 Noguchi et al.

FOREIGN PATENT DOCUMENTS

JP 3084763 B 9/2000
JP 2000-321827 A 11/2000

* cited by examiner

*Primary Examiner* — Gregory H Curran
(74) *Attorney, Agent, or Firm* — Hawaii Patent Services; Nathaniel K. Fedde; Kenton N. Fedde

(57) ABSTRACT

Provided is an image-forming apparatus that prevents a drop in processing speed even when a preceding job is interrupted by a simple job (interrupt job). The image-forming apparatus includes a printer unit that prints on paper, a first transporting path that passes by the printer unit, a second transporting path that path branches off from the first transporting path and moves paper that has been turned over from front to back further upstream than the printer unit, a storage unit that stores a condition table indicates conditions for which a preceding job can be interrupted by an interrupt job, and a system-control unit that references the condition table, and when the preceding job can be interrupted, sets a printing order so that printing of the interrupt job is inserted into the printing order of the preceding job.

2 Claims, 38 Drawing Sheets

(CONDITION TABLE: CONDITIONS FOR A PRECEDING JOB THAT CAN BE INTERRUPTED BY A SIMPLE JOB) 200

| TRANSPORTING PATTERN | CONDITIONS FOR A PRECEDING JOB THAT CAN BE INTERRUPTED |
|---|---|
| 1 Sheet Batch | 1 SHEET BATCH IS NOT POSSIBLE |
| 2 Sheet Batch | 2-PAGE DOUBLE-SIDED PRINTING |
| 3 Sheet Batch | 2-PAGE DOUBLE-SIDED PRINTING |
| 4 Sheet Batch | 2-PAGE DOUBLE-SIDED PRINTING OR 4-PAGE DOUBLE-SIDED PRINTING |

FIG.3

(CONDITION TABLE: CONDITIONS FOR A PRECEDING JOB THAT CAN BE INTERRUPTED BY A SIMPLE JOB) 200

| TRANSPORTING PATTERN | CONDITIONS FOR A PRECEDING JOB THAT CAN BE INTERRUPTED |
|---|---|
| 1 Sheet Batch | 1 SHEET BATCH IS NOT POSSIBLE |
| 2 Sheet Batch | 2-PAGE DOUBLE-SIDED PRINTING |
| 3 Sheet Batch | 2-PAGE DOUBLE-SIDED PRINTING |
| 4 Sheet Batch | 2-PAGE DOUBLE-SIDED PRINTING OR 4-PAGE DOUBLE-SIDED PRINTING |

PRINTING THE SECOND PAGE

PRINTING THE FOURTH PAGE

PRINTING THE FIRST PAGE

PRINTING THE THIRD PAGE

PRINTING THE SECOND PAGE

PRINTING OF THE SECOND PAGE

PRINTING OF THE THIRD PAGE

PRINTING OF THE FIFTH PAGE

PRINTING OF THE SECOND PAGE

IMAGE-FORMING APPARATUS WITH INTERRUPT PRINTING FUNCTION

INCORPORATION BY REFERENCE

This application is based on and claims the benefit of priority from Japanese Patent Application No. 2016-077925 filed on Apr. 8, 2016, the contents of which are hereby incorporated by reference.

BACKGROUND

The present disclosure relates to an image-forming apparatus with an interrupt printing function.

In an image-forming apparatus that is an MFP such as a printer, multifunction printer, copier and the like, there are models in which it is possible to register printing jobs from user terminals via a network. Moreover, the image-forming apparatus generally executes a printing process for printing jobs that do not have a priority setting in the order of being input.

Incidentally, there are also printing jobs such as printing one page on one side (hereafter, referred to as a simple job). Even in the case of such a simple job, by performing printing processes in the order of input, a later printing job must wait for a previously registered printing job to finish, which is inconvenient.

In a typical image-forming apparatus, in order to eliminate such an inconvenience, there are switch back means for turning over the paper, standby means for causing paper to wait in a stopped state on the paper-refeed transporting path, and control means for performing control of each of these means. When mixing paper of different paper sizes, and continuously performing reverse output and double-sided copying, the control means sets the space between the preceding paper and the following paper to be equal to or longer than the length in the transporting direction of the preceding paper.

SUMMARY

The image-forming apparatus of the present disclosure includes a printer unit, a first transporting path, a second transporting path, a storage unit and a system-control unit. The printer unit prints on paper. The first transporting path passes by the printer unit. The second transporting path branches off from the first transporting path and moves paper that has been turned over from front to back further upstream than the printer unit of the first transporting path. The storage unit stores a condition table that, based on the premise that paper is transported by the second transporting path, indicates conditions for which a preceding job that is double-sided printing can be interrupted by an interrupt job that is single-sided printing. The system-control unit, when the interrupt printing job is set, references the condition table, and when the preceding job can be interrupted, sets a printing order so that printing of the interrupt job is inserted into the printing order of the preceding job.

BRIEF DESCRIPTION OF THE DRAWINGS

FIG. 3 illustrates a condition table that gives conditions for which a preceding job can be interrupted by a simple job.

DETAILED DESCRIPTION

In the following, embodiments of the image-forming apparatus of the present disclosure will be explained with reference to FIG. 1 to FIG. 12. The image-forming apparatus that will be explained below as an example is an MFP, which is a multifunctional peripheral having, for example, a printing function, a copy function, a FAX function and a data receiving/transmitting function via a network.

Figure 1:
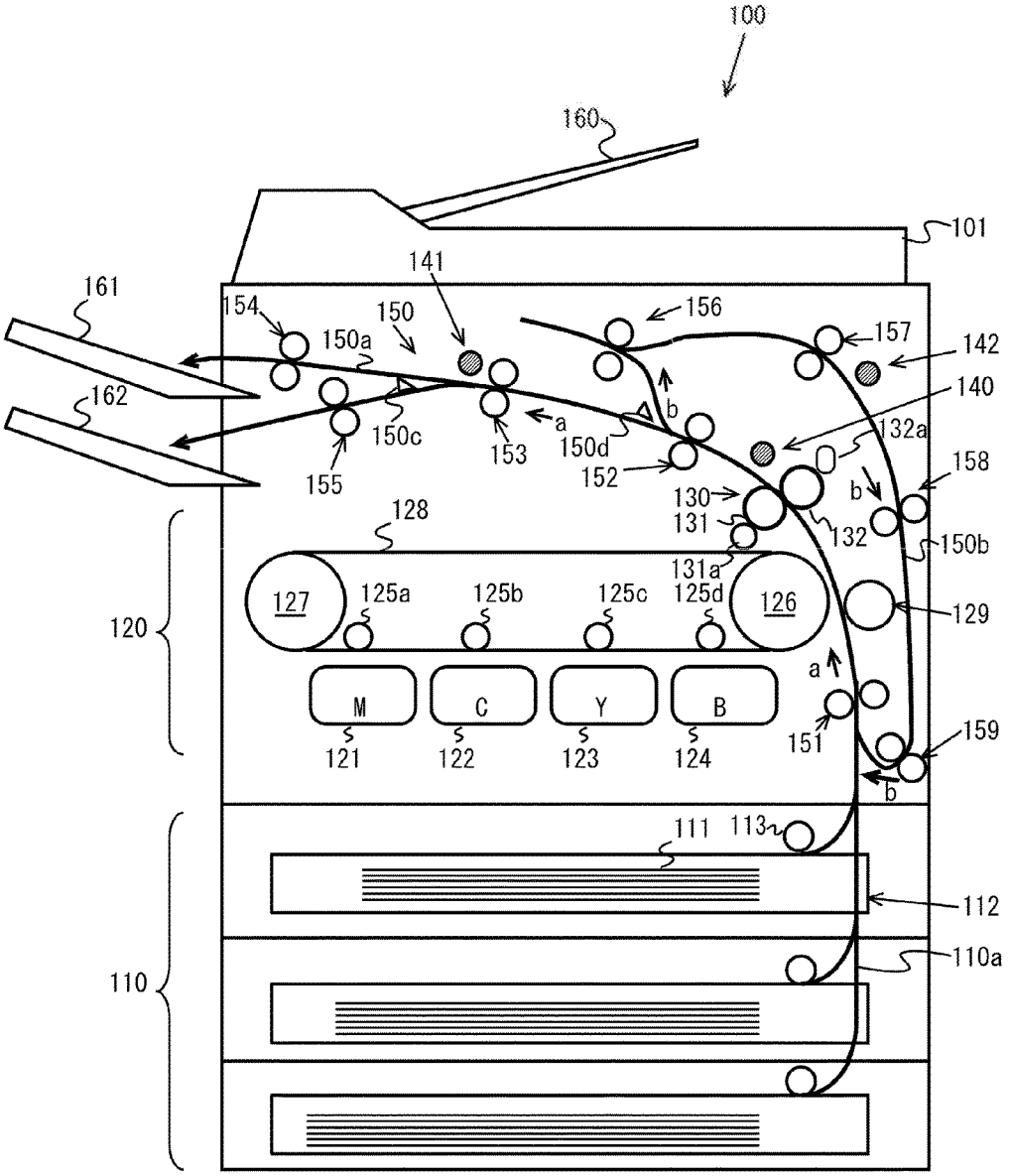
FIG. 1 illustrates an example of the configuration of an image-forming apparatus of the present disclosure.

First, as illustrated in FIG. 1, a paper-supply unit 110, a printer unit 120, paper-detection sensors 140 to 142, and a transporting unit 150 are installed inside a main unit 101 of a MFP 100. The reference number 160 indicates a paper-supply unit, and reference numbers 161 and 162 indicate paper-output trays.

The paper-supply unit 110 houses plural paper-supply cassettes 112 that are able to store various kinds of paper 111 having different paper sizes and paper types. Moreover, a paper-supply roller 113 is provided in each of the paper-supply cassettes 112. A paper-supply roller 113 feeds paper 111 from a paper-supply cassette 112 to a common transporting path 110*a* that is provided in each paper-supply cassette 112.

The printer unit 120 includes an image-forming unit (M) 121, an image-forming unit (C) 122, an image-forming unit (Y) 123 and an image-forming unit (B) 124 that have a photosensitive drum, a developing device, a charging device, an exposing device and the like. The image-forming unit (M) 121 is for magenta, the image-forming unit (C) 122 is for cyan, the image-forming unit (Y) 123 is for yellow, and the image-forming unit (B) 124 is for black.

Moreover, the printer unit 120 has primary transfer rollers 125*a,* to 125*d,* a drive roller 126, a follower roller 127, an intermediate-transfer belt 128, a secondary-transfer roller 129 and a fixing unit 130. The image-forming unit (M) 121, the image-forming unit (C) 122, the image-forming unit (Y) 123, and the image-forming unit (B) 124 form toner images on the photosensitive drums by charging, exposing and developing processes based on printing data. The primary-transfer rollers 125*a* to 125*d* transfer the toner images on the photosensitive drums to the intermediate-transfer belt 128 that is placed around the drive roller 126 and follower roller 127. The secondary-transfer roller 129 presses the paper 111 from the rear-surface side and transfers the toner image on the intermediate-transfer belt 128 to the front-surface side of the paper 111.

The fixing unit 130 has a heating roller 131 and a pressure roller 132. The heating roller 131 applies heat from a heat source 131*a* that is controlled by a heat-source control unit to the paper 111. The pressure roller 132 presses the paper 111 to the heating-roller 131 side. The pressure force of the pressure roller 132 is adjusted by a pressure-adjustment mechanism 132*a*. Then, the fixing unit 130 applies pressure by way of the pressure roller 132 and heat by way of the heating roller 131 to the paper 111 to which the toner image has been transferred by the drive roller 126 and secondary-transfer roller 129. As a result, the toner image is fixed to the paper 111. The pressure-adjustment mechanism 132*a* includes a pressure member that presses the pressure roller 132 in a direction toward the heating roller 131, a spring, and a drive unit such as a stepping motor, and by moving the pressure member by operating the drive unit, adjusts the pressure of the pressure roller 132.

The paper-detection sensors 140 to 142 detect the paper 111 on the transporting paths 150*a,* 150*b*. In other words, the paper-detection sensor 140 detects paper 111 on the transporting path 150*a* that has passed the fixing unit 130. The paper-detection sensor 141 detects paper 111 on the transporting path 150*a* that has passed a transporting-roller unit 153. The paper-detection sensor 142 detects paper 111 on the transporting path 150*b*.

The transporting unit 150 has transporting-roller units 151 to 159, and switching tabs 150*c,* 150*d*. Each of the transporting-roller units 151 to 159 has a drive roller and a follower roller. The transporting-roller units 151 to 154 are arranged on the transporting path 150*a* that extends from the common transporting path 110*a* to the paper-output tray 161. The transporting-roller unit 155 is arranged on the transporting path 150*a* that extends to the paper-output tray 162. Paper 111 that has undergone a printing process of a preceding job and paper 111 that has undergone a printing process of an interrupt printing job are switched by the switching tab 150*c* and transported to either the paper-output tray 161 or 162. In other words, when the output destination of paper 111 that has undergone a printing process of a preceding job is paper-output tray 161, the output destination of paper 111 that has undergone a printing process of an interrupt printing job becomes paper-output tray 162. In this way, it is easy to check the paper 111 that has been printed. The secondary-transfer roller 129 and the fixing unit 130 of the printer unit 120 that was described above are arranged between the transporting units 151 to 152.

When single-sided printing is set, the transporting-roller units 151 to 154 transport the paper 111 from the common transporting path 110*a* in the direction of arrow a along the transporting path 150*a*. While the paper is being transported in the direction of arrow a, the secondary-transfer roller 129 of the printer unit 120 transfers a toner image to the paper 111, and the heating roller 131 and the pressure roller 132 of the fixing unit 130 fix the toner image. Then, when the paper-output tray 161 is set as the output destination, for example, the paper 111 that has undergone the printing process is outputted to the paper-output tray 161. Moreover, when the paper-output tray 162 is set as the output destination, for example, the paper 111 that has undergone the printing process is outputted, by the switching tab 150*c* switching the transporting path, to the paper-output tray 162.

However, when double-sided printing is set, by the switching tab 150*d* switching the transporting path, the paper to which a toner image was fixed to the front side by the fixing unit 130 is moved to the transporting path 150*b* side. Here, the transporting-roller units 156 to 159 are arranged on the transporting path 150*b* that bypasses the transporting path 150*a* between the transporting-roller unit 151 and 152. The transporting path 150*b* includes a switch-back mechanism in which the transporting-roller unit 156 causes the paper 111 to be switched back. Then, when moving the paper 111 from the transporting path 150*b* side to the transporting path 150*a* side (downstream side of the printer unit 120), the front and back of the paper is reversed. Moreover, while the paper 111 is being transported in the direction of arrow a, the secondary-transfer roller 129 of the printer unit 120 transfers a toner image to the back surface of the paper 111, and the heating roller 131 and the pressure roller 132 of the fixing unit 130 fix the toner image. Then, when the paper-output tray 161 is set as the output destination for example, the paper 111 that has undergone the printing process is outputted to the paper-output tray 161. Moreover, when the paper-output tray 162 is set as the output destination for example, by the switching tab 150*c* switching the transporting path, the paper 111 that has undergone the printing process is outputted to the paper-output tray 162.

Figure 2:
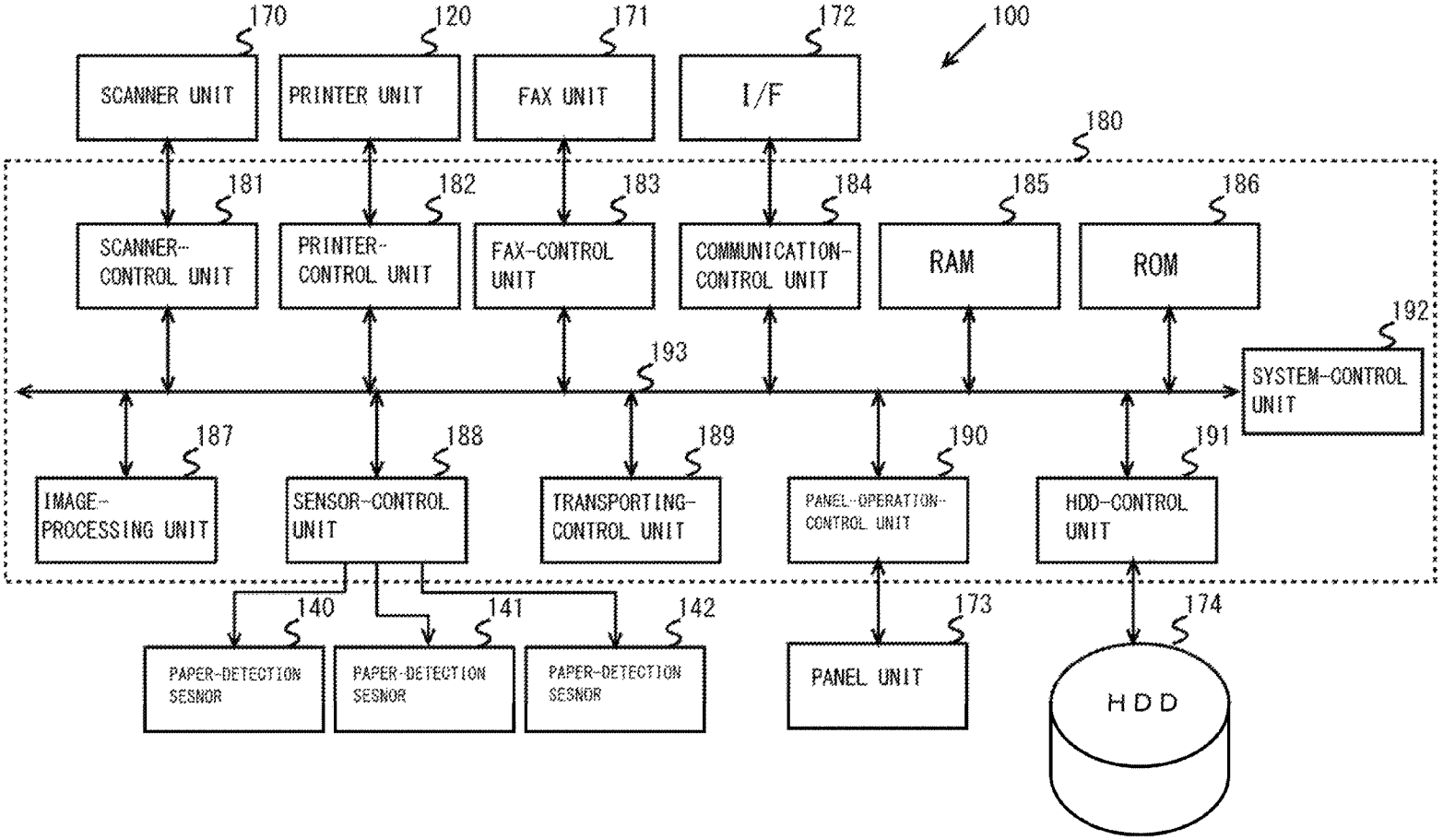
FIG. 2 illustrates an example of the configuration of the MFP control system in FIG. 1.

Next, referring to FIG. 2, an example of the configuration of the control system for the MFP 100 will be explained. The MFP 100 includes a control unit 180 that controls the scanner unit 170, the printer unit 120, the FAX unit 171, the I/F 172, the paper-detection sensors 140 to 142, the panel unit 173, and the HDD 174.

The scanner unit 170 is a device that converts an image of a document that is read by an image sensor to digital image data, and inputs that data to the control unit 180. The printer unit 120 is a device that prints an image on paper 111 based on printing data that is outputted from the control unit 180. The FAX unit 171 is a device that transmits data that is outputted from the control unit 180 to a facsimile of another party by way of telephone lines, and receives data from a facsimile of another party and inputs that data to the control unit 180.

The I/F 172 is a device such as a network interface card that receives communication from another user terminal, a content server, a web server and the like via a network such as an in-house LAN, the Internet and the like. The paper-detection sensors 140 to 142 detect paper 111 that is on a transporting path 150*a*, 150*b* as described above. The panel unit 173 is a device such as a touch panel that performs a display for the printing function, copy function, FAX function, data transmitting/receiving function via a network, and for various settings of the MFP 100. The HDD 174 is a storage device for storing application programs and the like for providing the various functions of the MFP 100. Moreover, the HDD 174 has a user box for registering printing jobs that are received from a user terminal via a network.

The control unit 180 is a processor for executing an image-forming program and control program for controlling the overall operation of the MFP 100. The control unit 180 includes a scanner-control unit 181, a printer-control unit 182, a FAX-control unit 183, a communication-control unit 184, RAM 185, ROM 186, an image-processing unit 187, a sensor-control unit 188, a transporting-control unit 189, a panel-operation-control unit 190, an HDD-control unit 191 and a system-control unit 192. Moreover, these are connected to a database 193.

The scanner-control unit 181 controls the reading operation by the scanner unit 170. The printer-control unit 182 controls the printing operation by the printer unit 120. The FAX-control unit 183 controls the data transmitting/receiving operation by the FAX unit 171. The communication-control unit 184 performs control of transmitting or receiving data and the like via a network and by way of the I/F 172.

The RAM 185 is a work memory for executing programs. Moreover, the RAM 185 stores printing data that has undergone image processing by the image-processing unit 187. The ROM 186 stores control programs for performing operation checks and the like for all of the units. The image-processing unit 187 performs image processing on image data that is read by the scanner unit 170, for example. Moreover, the image-processing unit 187 performs image processing on printing jobs that are registered in the HDD 174.

The sensor-control unit 188 controls the detection operation by the paper-detection sensors 140 to 142. The transporting-control unit 189, when single-sided printing is set, drives the transporting-roller units 151 to 154 in the forward direction (direction for transporting the paper 111 along the transporting path 150*a* in the direction of arrow a), and outputs the paper 111 to the paper-output tray 161, for example. Moreover, the transporting-control unit 189, by switching by the switching tab 150*c*, drives the transporting-roller unit 155 in the forward direction, and outputs the paper 111 to the paper-output tray 162, for example. Moreover, the transporting-control unit 189, when double-sided printing is set, drives the transporting-roller units 151 to 154 in the forward direction, and drives the transporting-roller units 156 to 159 in the opposite direction (direction that transports the paper 111 in the direction of arrow b). Furthermore, the transporting-control unit 189, switches the switching tab 150*d* and causes the paper 111 to be transported in the direction of arrow b. Moreover, the transporting-control unit 189 switches the switching tab 150*d* and causes the paper 111 that has been printed on both sides to be output to the paper-output tray 161. The transporting-control unit 189, when interrupt printing is set, switches the switching tab 150*c* and causes the paper 111 for which interrupt printing has finished to be output to the paper-output tray 162, for example. As a result, paper 111 for which printing is performed for a preceding job, and paper 111 that is printed by interrupt printing can be divided and output to paper-output tray 161 or 162. The output destination for the paper 111 is set according to a setting performed by way of the panel unit 173.

The panel-operation-control unit 190 controls the display operation by the panel unit 173. Moreover, the panel-operation-control unit 190, by way of the panel unit 173, receives the start or the like for printing (single-sided printing, double-sided printing, and the like), copying, a FAX, data transmitting/receiving via a network and the like. Furthermore, the panel-operation unit 190, by way of the panel unit 173, receives the setting for interrupt printing. The HDD-control unit 191 controls reading and writing of data to the HDD 174.

The system-control unit 192 controls cooperative operation of each of the units. In other words, the system-control unit 192, when single-sided printing or double-sided printing is set by way of the panel unit 173, mainly causes the transporting-control unit 189 to drive according to single-sided printing or double-sided printing. Moreover, as will be described in more detail later, when a preceding printing job is set as double-sided printing, and interrupt printing is set for a printing job that is set for one-page of single-sided printing (hereafter, referred to as a simple job), the system-control unit 192 determines conditions such as the paper size, number of sheets to be printed, sheet batch number and the like for the preceding job, and starts single-sided printing for the simple job at timing when interrupting is possible. Furthermore, the system-control unit 192 switches the switching tab 150*c* by way of the transporting-control unit 189 so that paper 111 for which the printing process for a preceding job is finished is outputted to the paper-output tray 161, for example. The system-control unit 192 also switches the switching tab 150*c* by way of the transporting-control unit 189 so that paper 111 for which the printing process for a simple job is finished is outputted to the paper-output tray 162, for example. The system-control unit 192 controls switching of the switching tabs 150*c*, 150*d* based on detection results from the paper-detection sensors 140 and 141.

Next, referring to FIG. 3, a condition table that gives conditions for a preceding job that can be interrupted by a simple job will be explained. First, in the condition table 200, the transporting pattern for the paper 111 that is indicated by N Sheet Batch (N is a positive integer) and the contents of a preceding job that can be interrupted are given. The transporting pattern is set between 1 Sheet to 4 Sheets. Here, 1 Sheet to 4 Sheets is divided according to the paper size and the printing unit of the image data that is stored in a video buffer (the printing unit indicates a page that will be printed on the front and back surface of one sheet of paper 111). When taking into consideration only the paper size, 1 Sheet Batch indicates size A2 for example, 2 Sheet Batch indicates size A4 for example, 3 Sheet Batch indicates size A4 for example, and 4 Sheet Batch indicates size B5 for example. However, when the speed for generating image data from printing data becomes slow, the Sheet Batch (transporting pattern) may be set to a smaller number N for the paper sizes above. Moreover, in the present embodiment, in the case of a 1 Sheet Batch, interrupt is set as not possible. In the case of 2 Sheet Batch and 3 Sheet Batch, when 2-page double-sided printing is set, interrupt is set as possible. Moreover, in the case of a 4 Sheet Batch, when 2-page double-sided printing is set or 4-page double-sided printing is set, interrupt is set as possible.

As a simple job that interrupts a preceding job, a 2 Sheet Batch in which 1-page single-sided printing is performed is possible. The pages of the preceding job, in addition to pages that are included in the printing data, includes blank pages of paper 111 that have been printed. Therefore, when performing double-sided printing of printing data when the number of pages included in the printing data is odd, the portion of the last page of blank pages of printed matter is included in the number of pages given as the contents of a preceding job that can be interrupted in the condition table 200.

Moreover, in the case in which the preceding job is 2-page double-sided printing in a 4 Sheet Batch, in addition to 1-page single-sided printing as a simple job that interrupts the preceding job, 2-page single-sided printing is also possible. Therefore, in the condition table 200, in addition to the transporting pattern and the contents of the preceding job that can be interrupted, the number of pages of single-sided printing (or the number of sheets of paper 111) that can interrupt can be set as a simple job.

The condition table 200 that gives conditions of a preceding job that can be interrupted by a simple job can be stored in the RAM 185 or HDD 174. Moreover, the system-control unit 192 determines whether interrupt by a simple job is possible by referencing the condition table 200 when interrupt printing has been set by way of the panel unit 173.

Figure 4A:
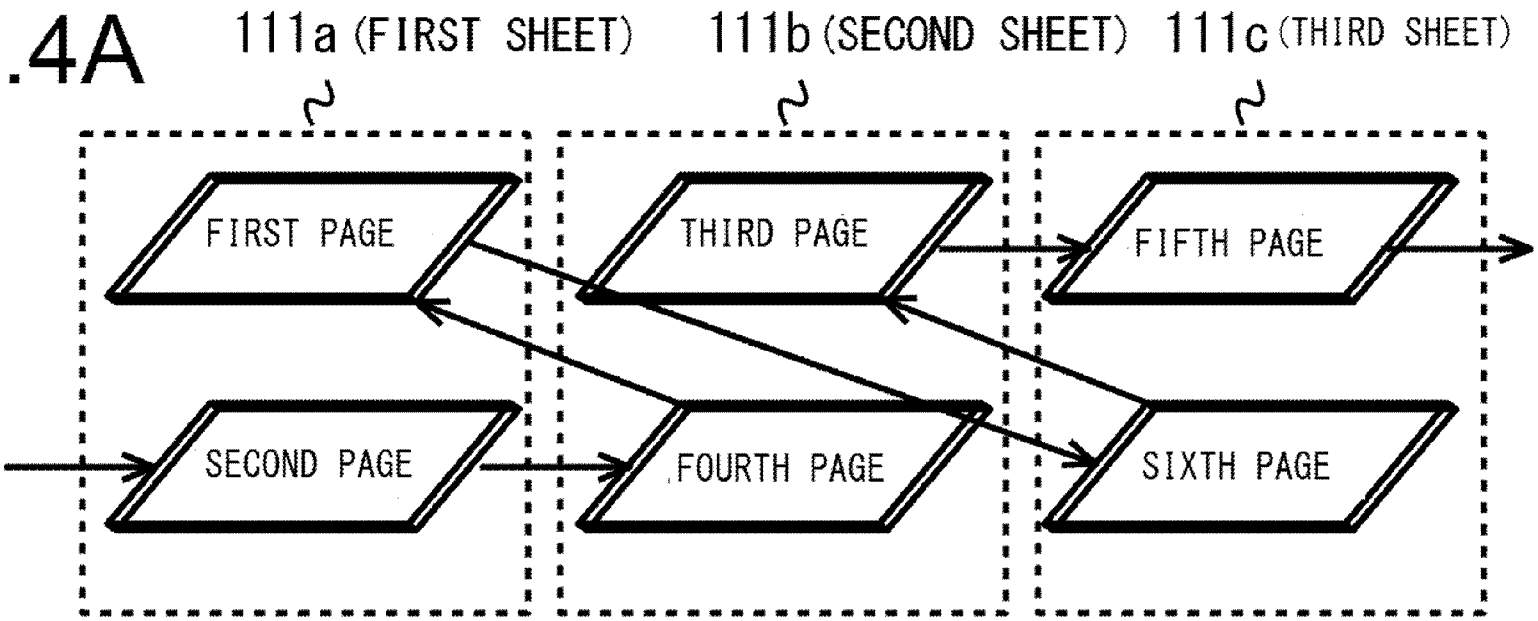
FIG. 4A explains the printing order in conditions for which a preceding job can be interrupted by a simple job, and illustrates the printing order for a 3-sheet batch condition when a preceding job is 6-page double-sided printing.

Next, the printing order in the conditions of a preceding job that can be interrupted by a simple job will be explained. First, FIGS. 4A to 4E and FIGS. 5F to 5H illustrate the printing order in the condition of a 3 Sheet Batch when the preceding job is 6-page double-sided printing. The printing order in the case of a 3 Sheet Batch, as illustrated in FIG. 4A, is such that printing is started from the second page and ends with the fifth page. As a result, the first page and the second page are printed on the first sheet of paper 111*a*, the third page and the fourth page are printed on the second sheet of paper 111*b*, and the fifth page and sixth page are printed on the third sheet of paper 111*c*.

Figure 4B:
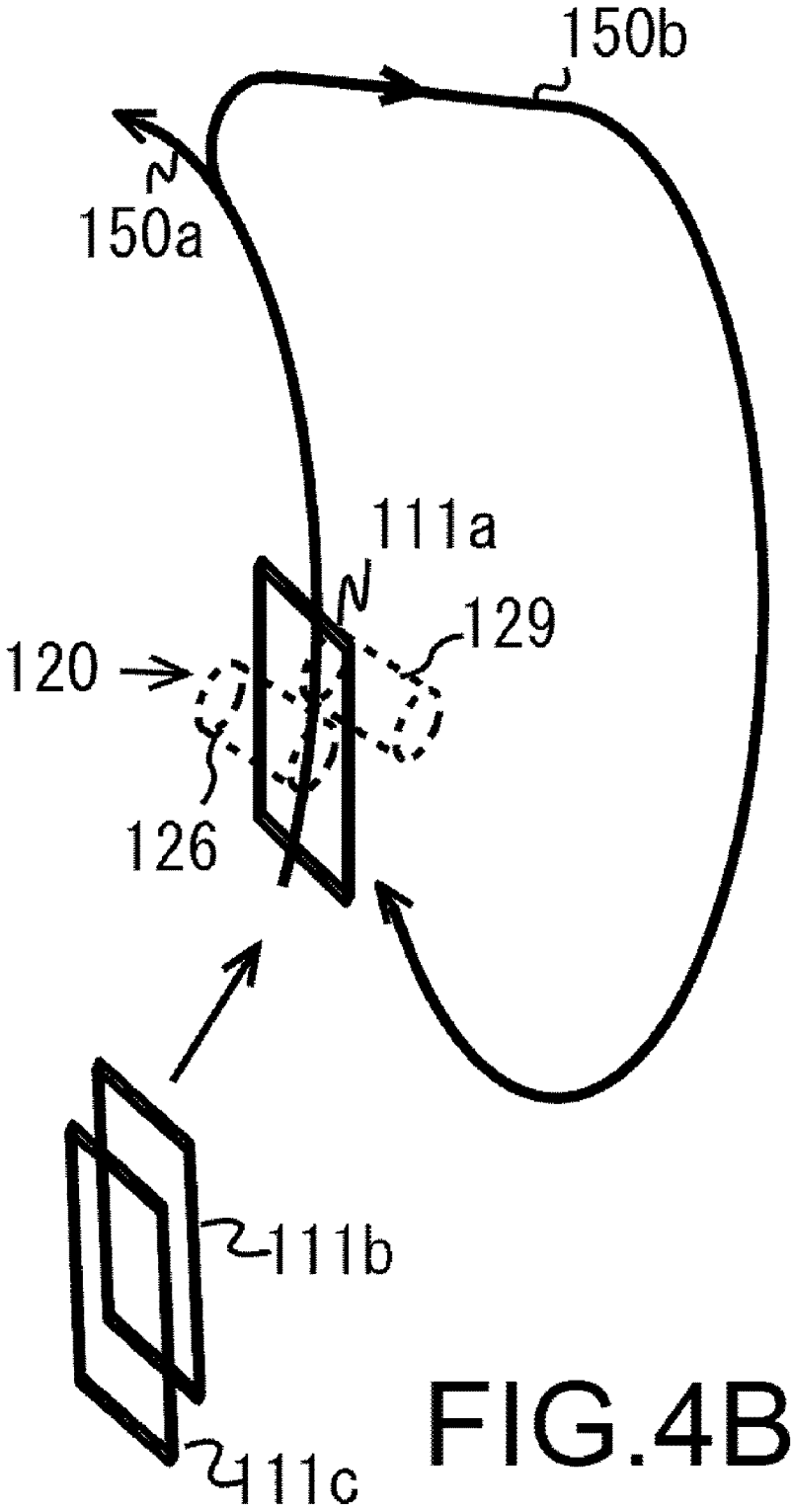
FIG. 4B explains the printing order in conditions for which a preceding job can be interrupted by a simple job, and illustrates the case in which the second page is printed.
Figure 4C:
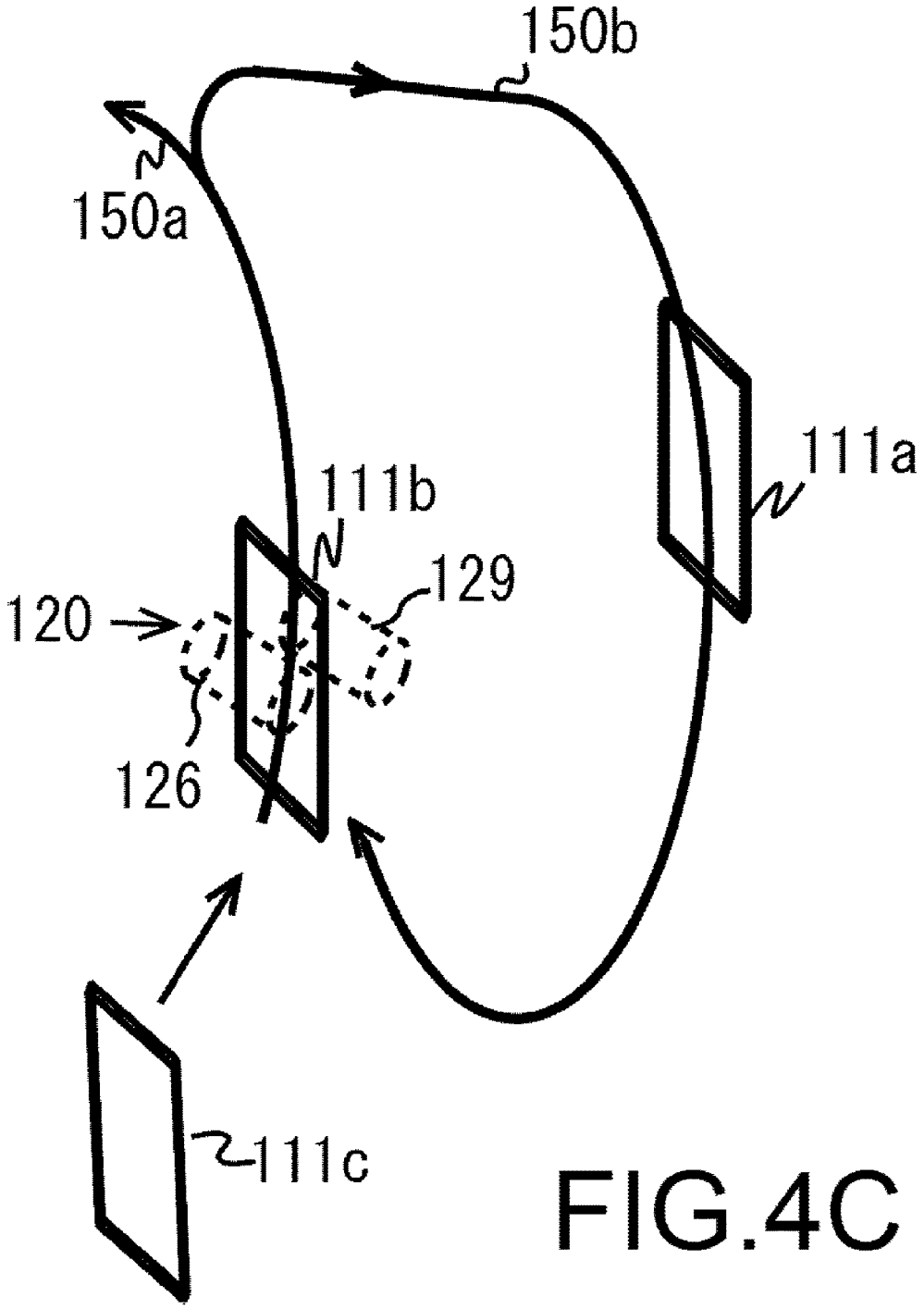
FIG. 4C explains the printing order in conditions for which a preceding job can be interrupted by a simple job, and illustrates the case in which the fourth page is printed.
Figure 4D:
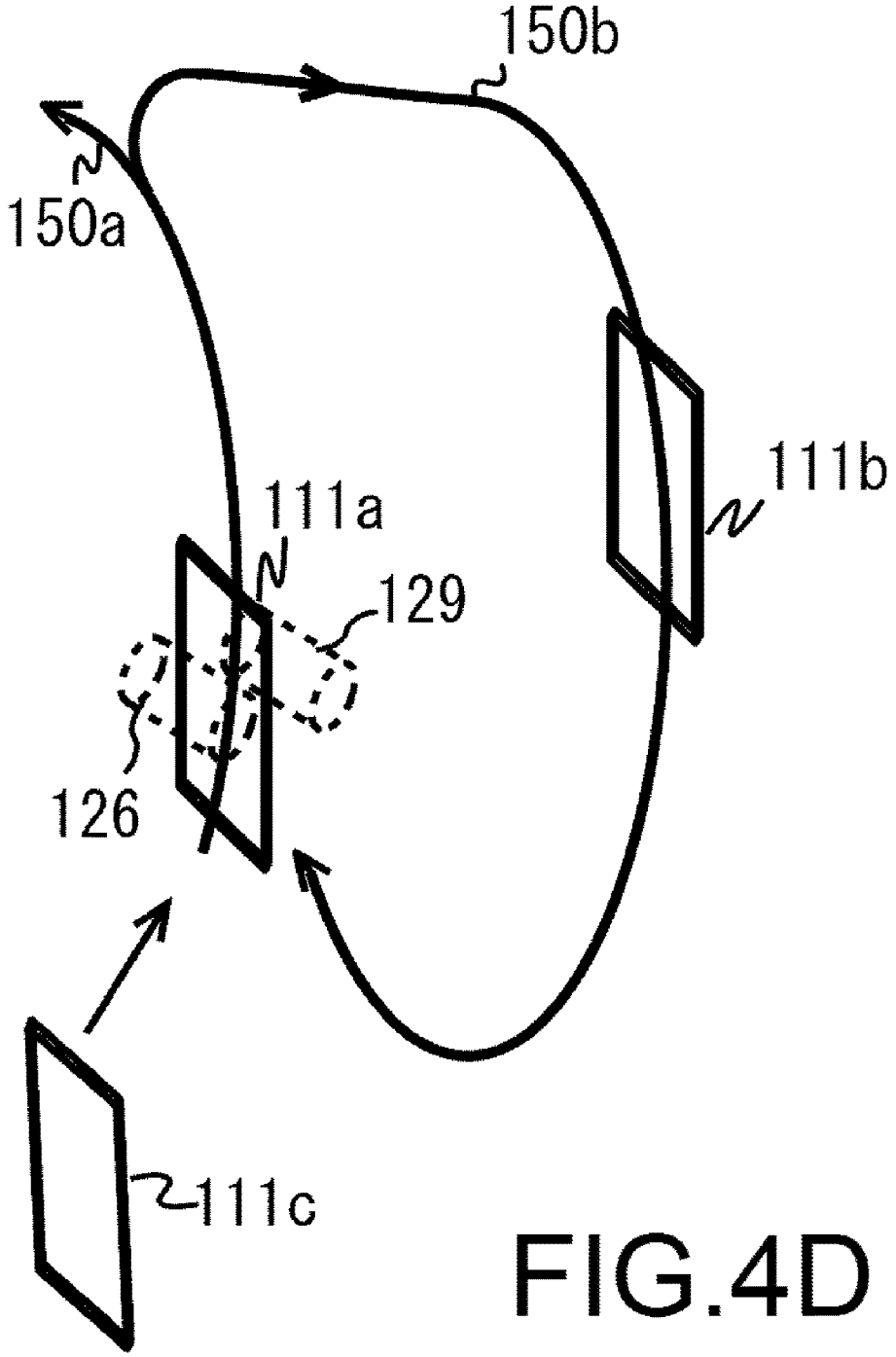
FIG. 4D explains the printing order in conditions for which a preceding job can be interrupted by a simple job, and illustrates the case in which the first page is printed.
Figure 4E:
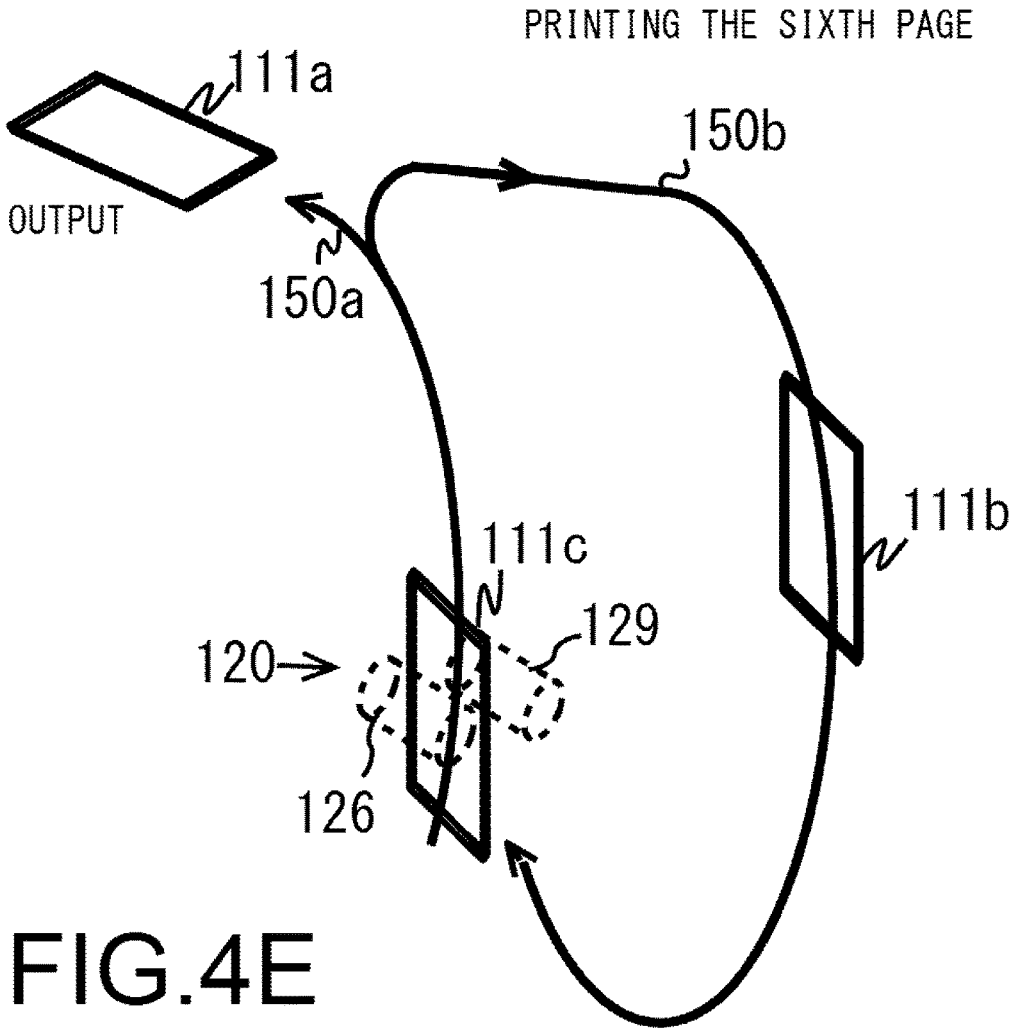
FIG. 4E explains the printing order in conditions for which a preceding job can be interrupted by a simple job, and illustrates the case in which the sixth page is printed.
Figure 5F:
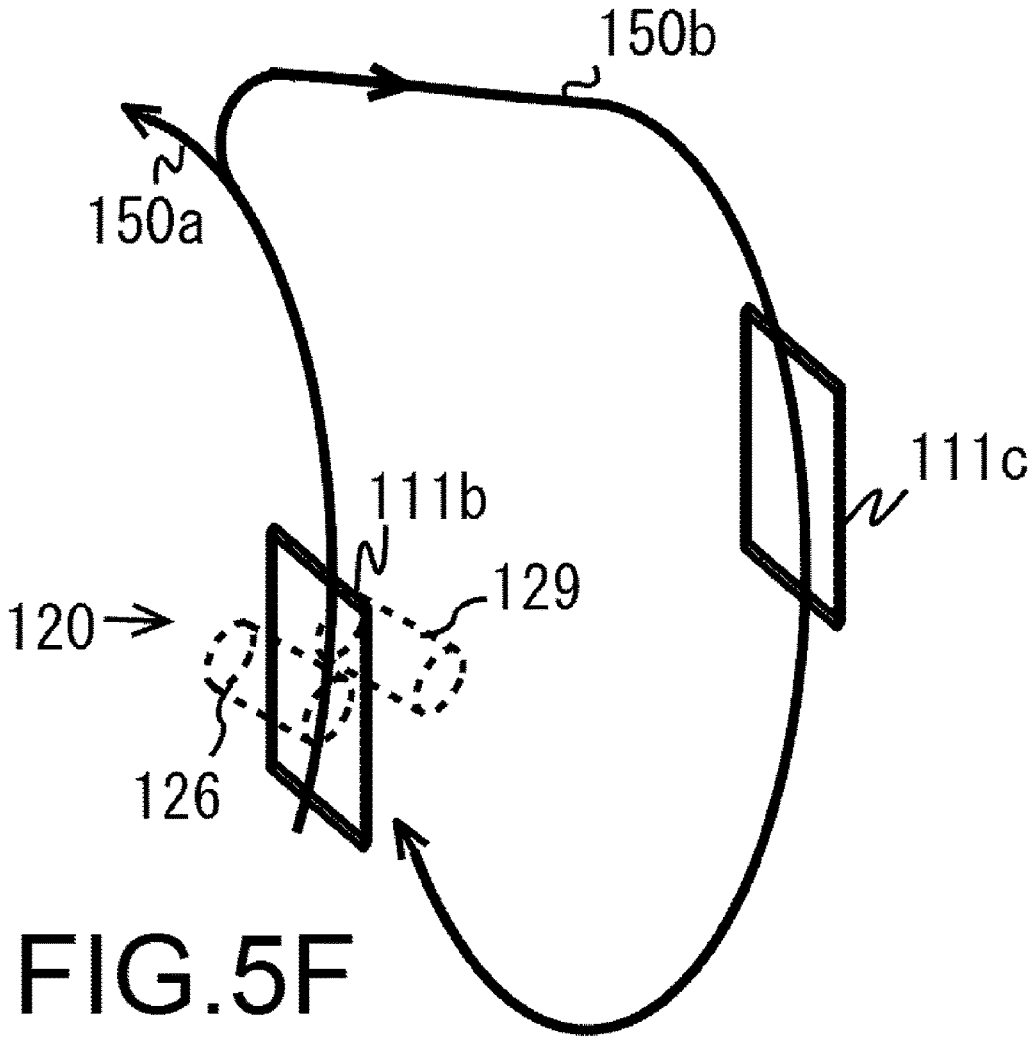
FIG. 5F explains the printing order in conditions for which a preceding job can be interrupted by a simple job, and illustrates the case in which the third page is printed.
Figure 5G:
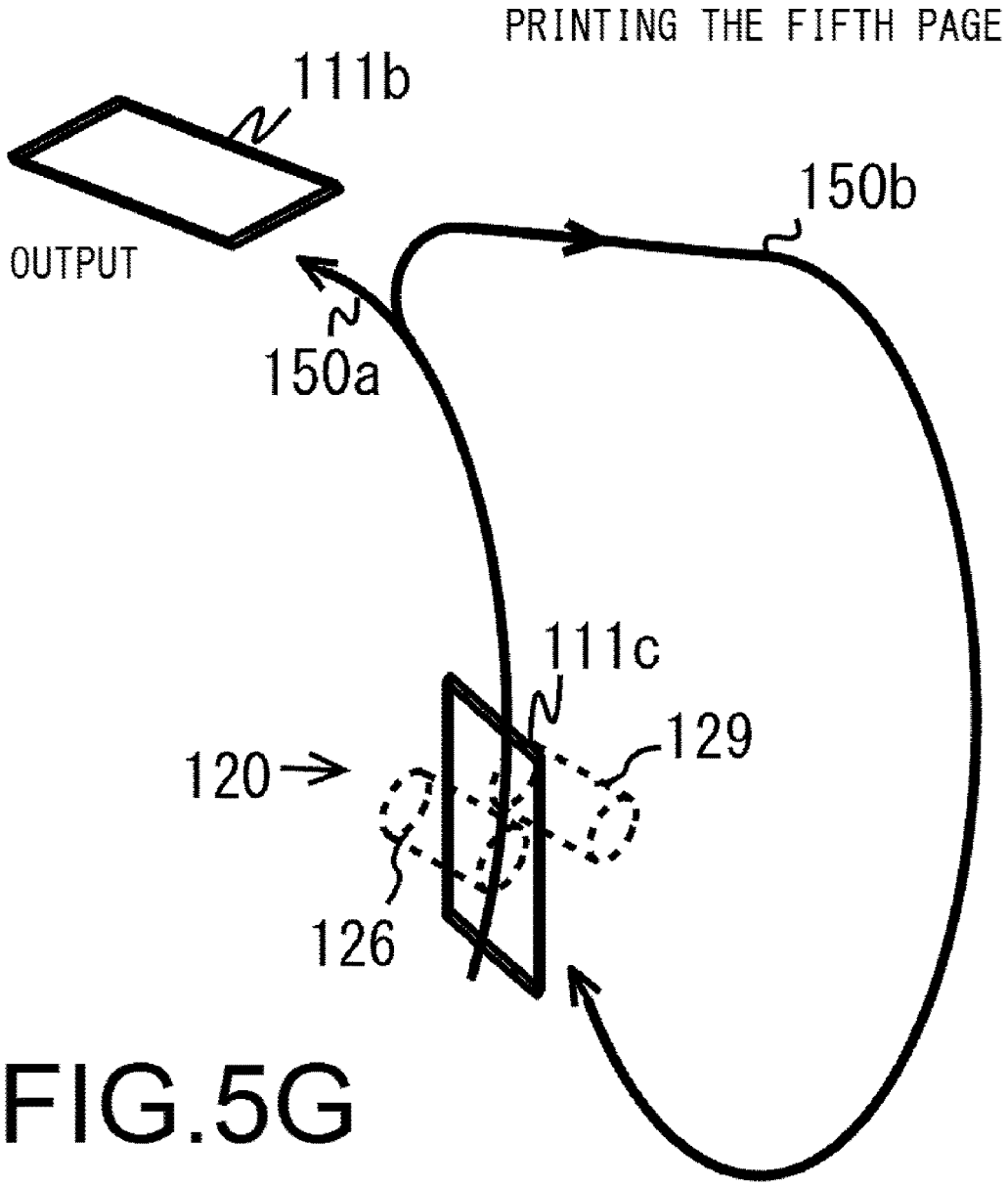
FIG. 5G explains the printing order in conditions for which a preceding job can be interrupted by a simple job, and illustrates the case in which the fifth page is printed.
Figure 5H:
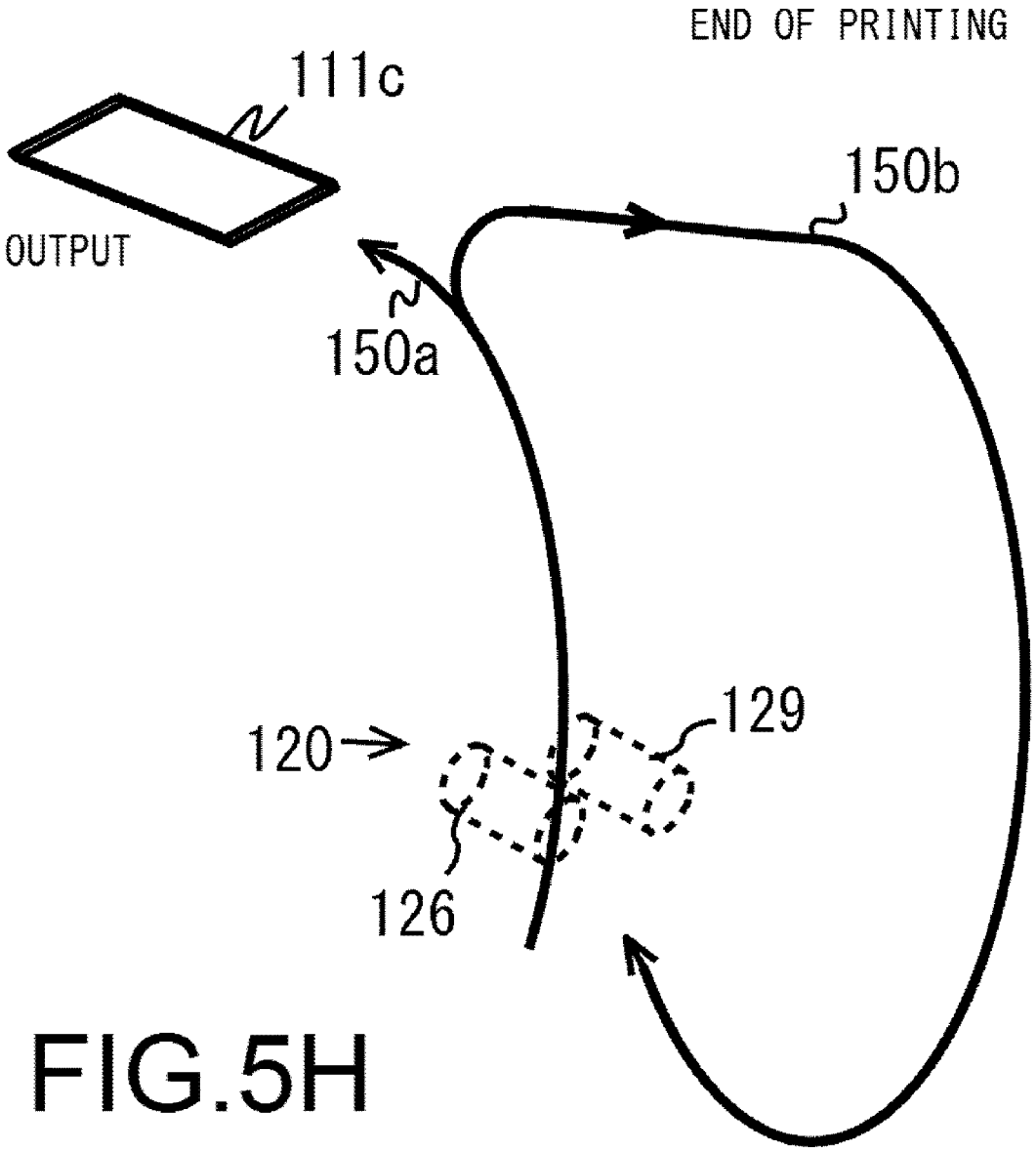
FIG. 5H explains the printing order in conditions for which a preceding job can be interrupted by a simple job, and illustrates the case in which printing is finished.

In other words, after the second page is printed on the front surface of the first sheet of paper 111*a* as illustrated in FIG. 4B, the first sheet of paper 111*a* is moved to the transporting path 150*b* side that branches off from the transporting path 150*a* as illustrated in FIG. 4C. At the same time as this, the fourth page is printed on the front surface of the second sheet of paper 111*b*. Continuing, as illustrated in FIG. 4D, after the second sheet of paper 111*b* is moved to the transporting path 150*b* side, the first sheet of paper 111*a* that has been turned over from front to back in the transporting path 150*b* is moved from the junction between the transporting path 150*a* and the transporting path 150*b* to the transporting path 150*a*. As a result, the first page is printed on the back surface. Moreover, as illustrated in FIG. 4E, at the same time that the first sheet of paper 111*a* is outputted, the sixth page is printed on the front surface of the third sheet of paper 111*c*. After that, as illustrated in FIG. 5F, the third page is printed on the back surface of the second sheet of paper 111*b*, and as illustrated in FIG. 5G, the fifth page is printed on the back surface of the third sheet of paper 111*c*. As illustrated in FIG. 5H, printing ends. The junction between the transporting path 150*a* and the transporting path 150*b* is on the upstream side from the printer unit 120 of the transporting path 150*a*, and more specifically, is upstream from the secondary transfer roller 129 of the transporting path 150*a*, and even more specifically, is just before the transporting-roller unit 151 (refer to FIG. 1) of the transporting path 150*a*.

Figure 6A:
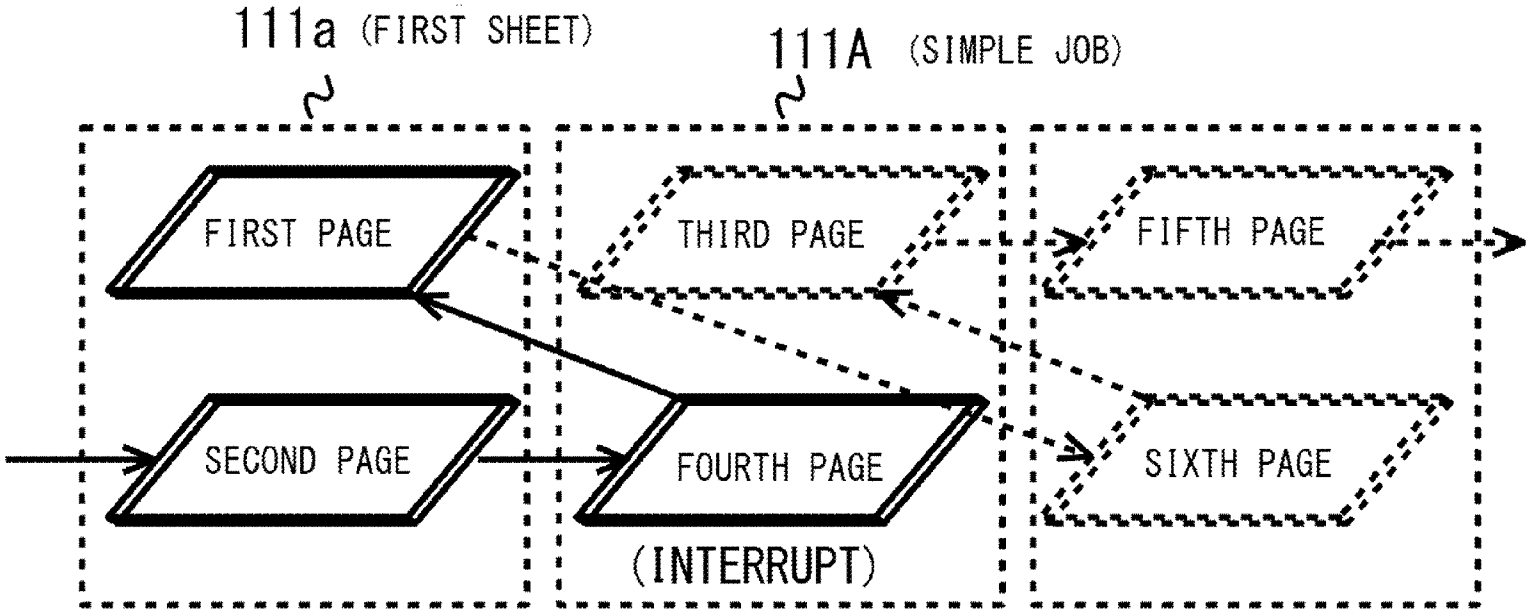
FIG. 6A explains interrupt printing for a 3-sheet batch condition when a preceding job is 2-page double-sided printing, and illustrates interrupt insertion of a simple job.
Figure 6B:
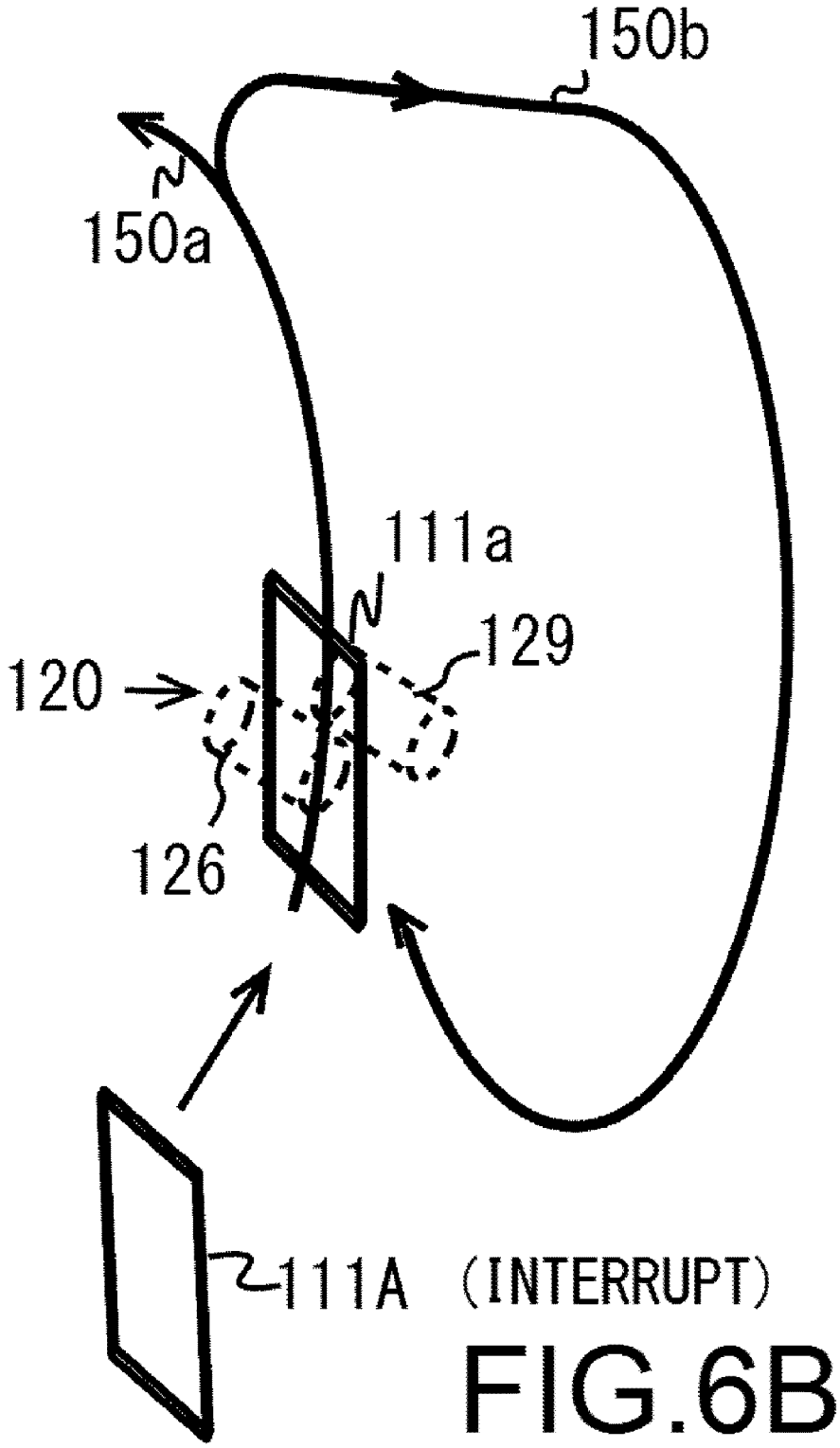
FIG. 6B explains interrupt printing for a 3-sheet batch condition when a preceding job is 2-page double-sided printing, and illustrates the case in which the second page is printed.
Figure 6C:
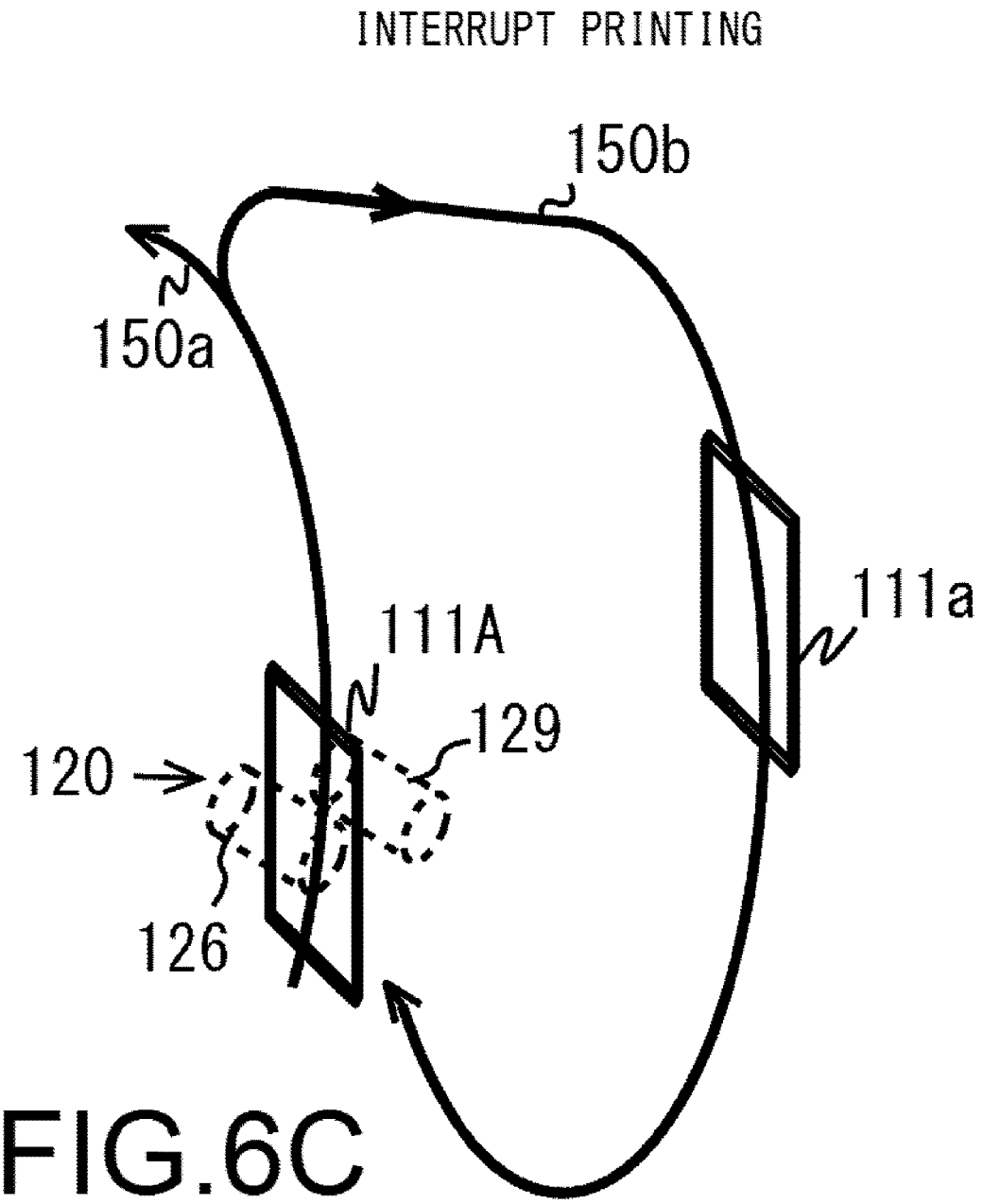
FIG. 6C explains interrupt printing for a 3-sheet batch condition when a preceding job is 2-page double-sided printing, and illustrates printing of a simple job.
Figure 6D:
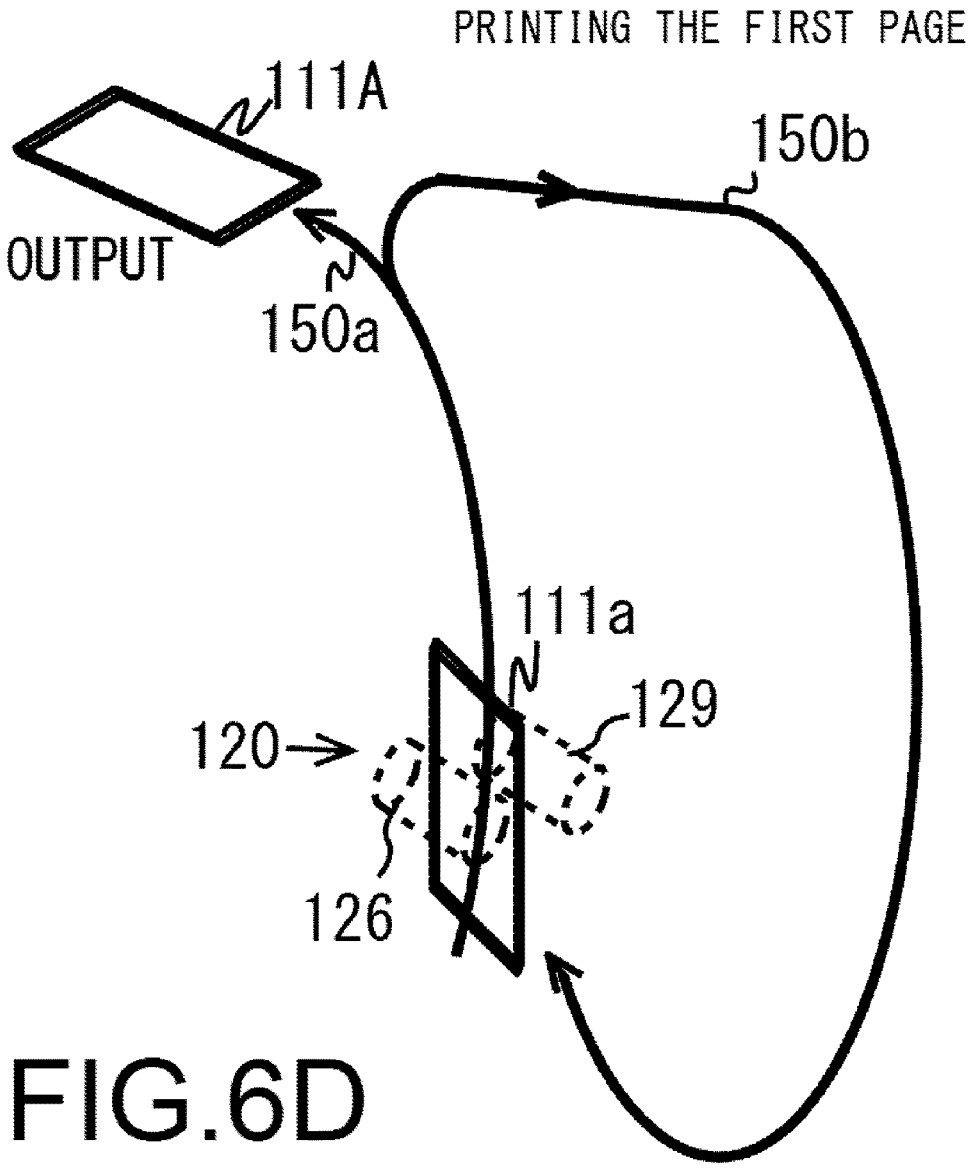
FIG. 6D explains interrupt printing for a 3-sheet batch condition when a preceding job is 2-page double-sided printing, and illustrates the case in which the first page is printed.
Figure 6E:
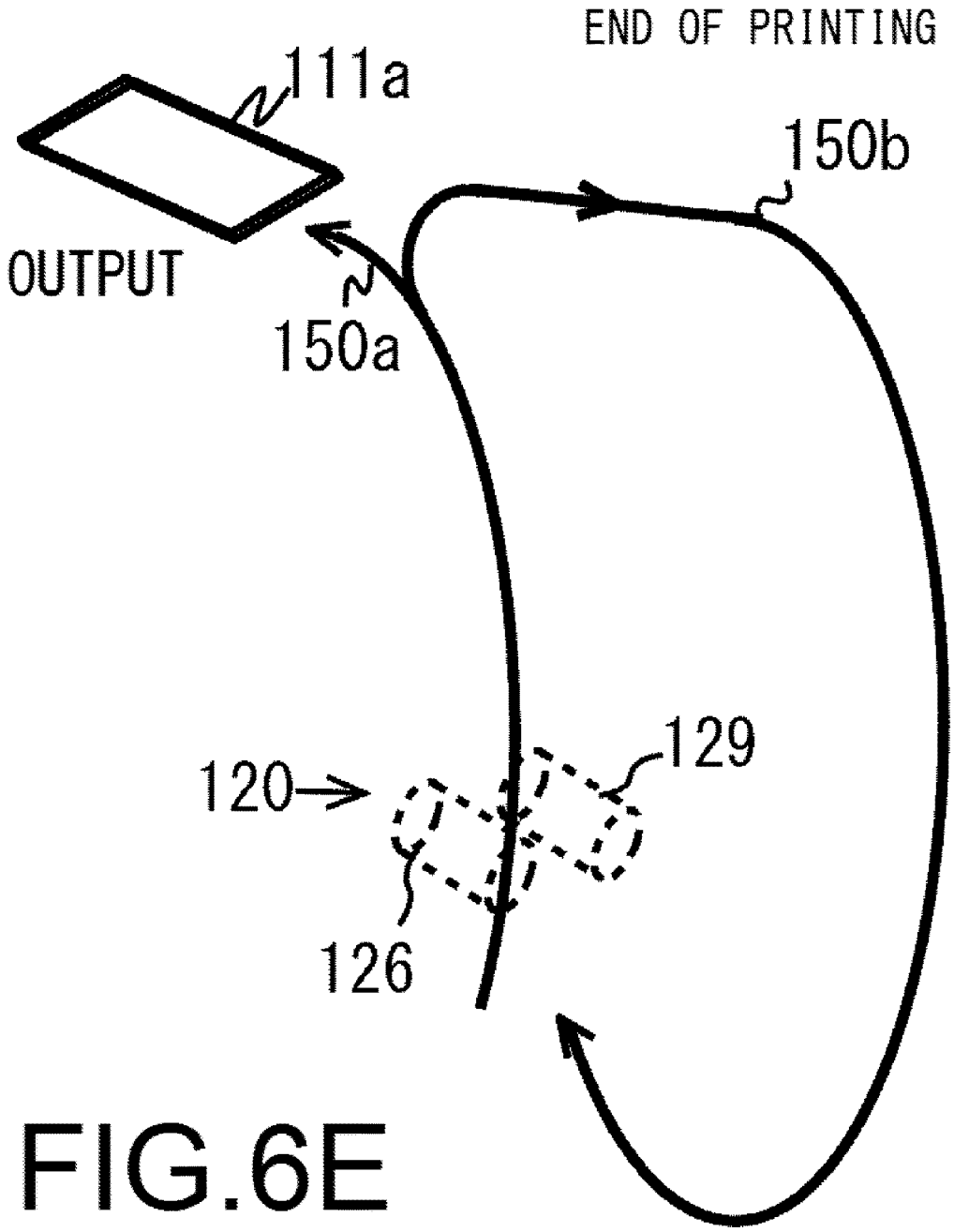
FIG. 6E explains interrupt printing for a 3-sheet batch condition when a preceding job is 2-page double-sided printing, and illustrates the case in which printing is finished.

Next, referring to FIGS. 6A to 6E, interrupt printing in the condition of a 3 Sheet Batch when the preceding job is 2-page double-sided printing will be explained. First, as illustrated in FIG. 6A, the paper 111A of a simple job interrupts and is inserted after the second page of the first sheet of paper 111*a* is printed. In other words, as illustrated in FIG. 6B, after the second page is printed on the front surface of the first sheet of paper 111*a*, as illustrated in FIG. 6C, the first sheet of paper 111*a* is then moved to the transporting path 150*b* that branches off from the transporting path 150*a*. At the same time as this, the image of the simple job is printed on the front surface of the paper 111A of the simple job. Next, as illustrated in FIG. 6D, at the same time that the paper 111A of the simple job is outputted, the first sheet of paper 111*a* that has been turned over from front to back in the transporting path 150*b* is moved to the transporting path 150*a* from the junction between the transporting path 150*a* and the transporting path 150, and the first page is printed on the back surface of the paper 111*a*. Then, as illustrated in FIG. 6E, the first sheet of paper 111*a* is outputted and printing ends. As a result, when the first sheet of paper 111*a* is on the transporting path 150*b*, interrupt printing is executed on the paper 111A of the simple job, so the job is continued to the first sheet of paper 111*a* without stopping.

The printing order in a 3 Sheet Batch condition when the preceding job is 4-page double-side printing is: the second page to the fourth page to the first page to the third page. The printing order in the case of an interrupt by a simple job becomes: the second page to the fourth page to the first page to the simple job (interrupt) to the third page. Moreover, as illustrated in FIG. 4A, the printing order in a 3 Sheet Batch condition when the preceding job is 6-page double-sided printing is: the second page to the fourth page to the first page to the sixth page to the third page to the fifth page. The printing order in the case of an interrupt by a simple job becomes: the second page to the fourth page to the first page to the sixth page to the third page to the simple job (interrupt) to the fifth page.

Figure 7A:
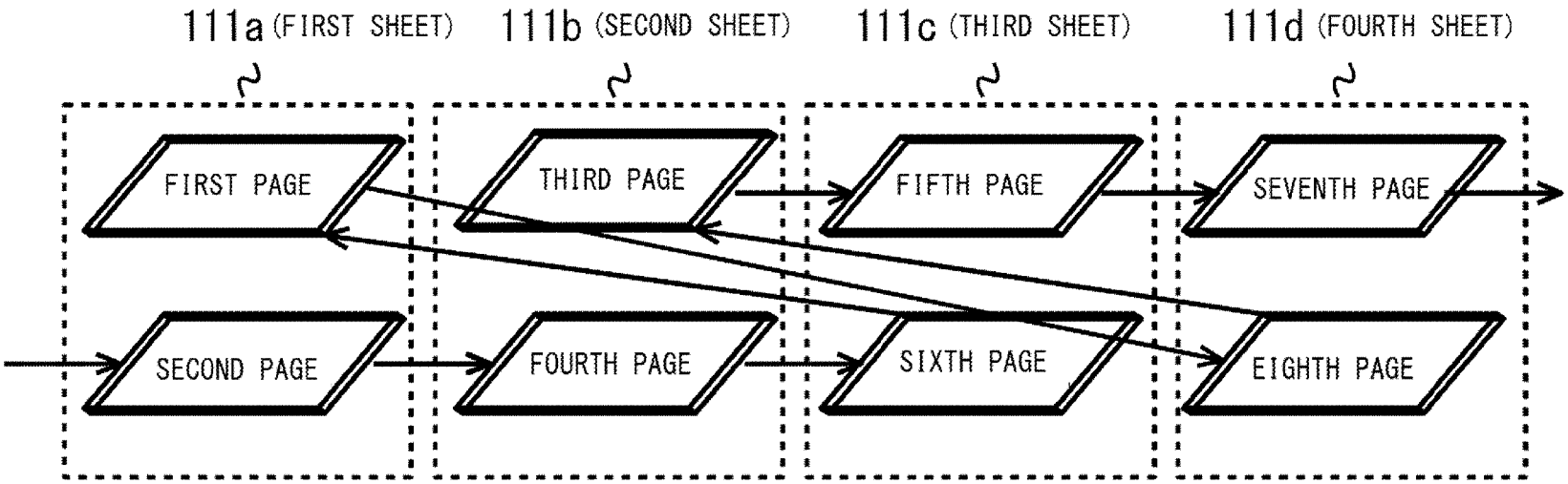
FIG. 7A explains the printing order in conditions for which a preceding job can be interrupted by a simple job, and illustrates the printing order for a 4-sheet batch condition when a preceding job is 8-page double-sided printing.

Next, referring to FIGS. 7A to 7E and FIGS. 8G to 8I, the printing order in a 4 Sheet Batch condition when the preceding job is 8-page double-sided printing will be explained. First, as illustrated in FIG. 7A, the printing order in the case of a 4 Sheet Batch is set so that printing starts from the second page and printing ends at the seventh page. As a result, the first page and the second page are printed on the first sheet of paper 111*a*, the third page and the fourth page are printed on the second sheet of paper 111*b*, the fifth page and the sixth page are printed on the third sheet of paper 111*c* and the seventh page and the eighth page are printed on the fourth sheet of paper 111*d*.

Figure 7B:
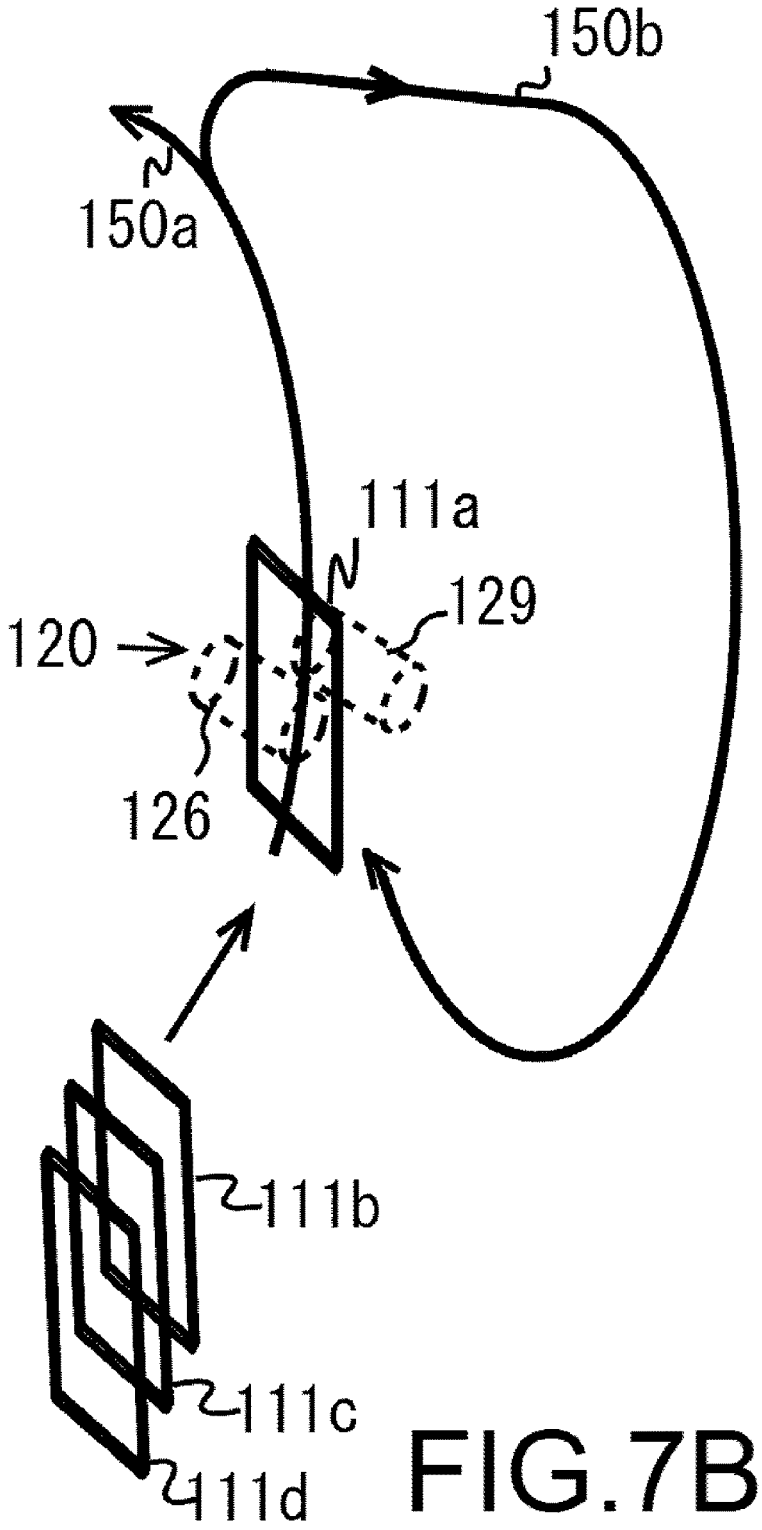
FIG. 7B explains the printing order in conditions for which a preceding job can be interrupted by a simple job, and illustrates the case in which the second page is printed.
Figure 7C:
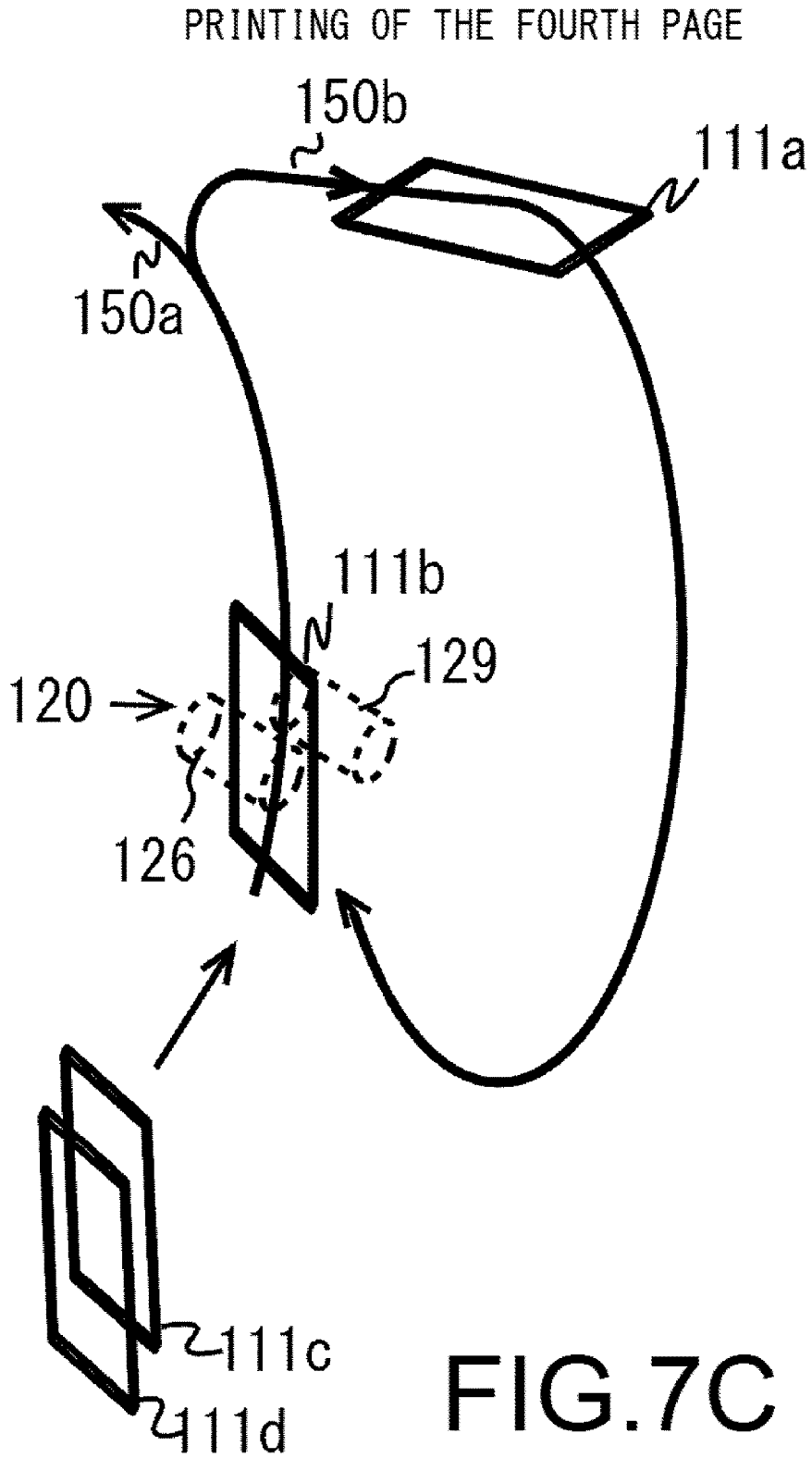
FIG. 7C explains the printing order in conditions for which a preceding job can be interrupted by a simple job, and illustrates the case in which the fourth page is printed.
Figure 7D:
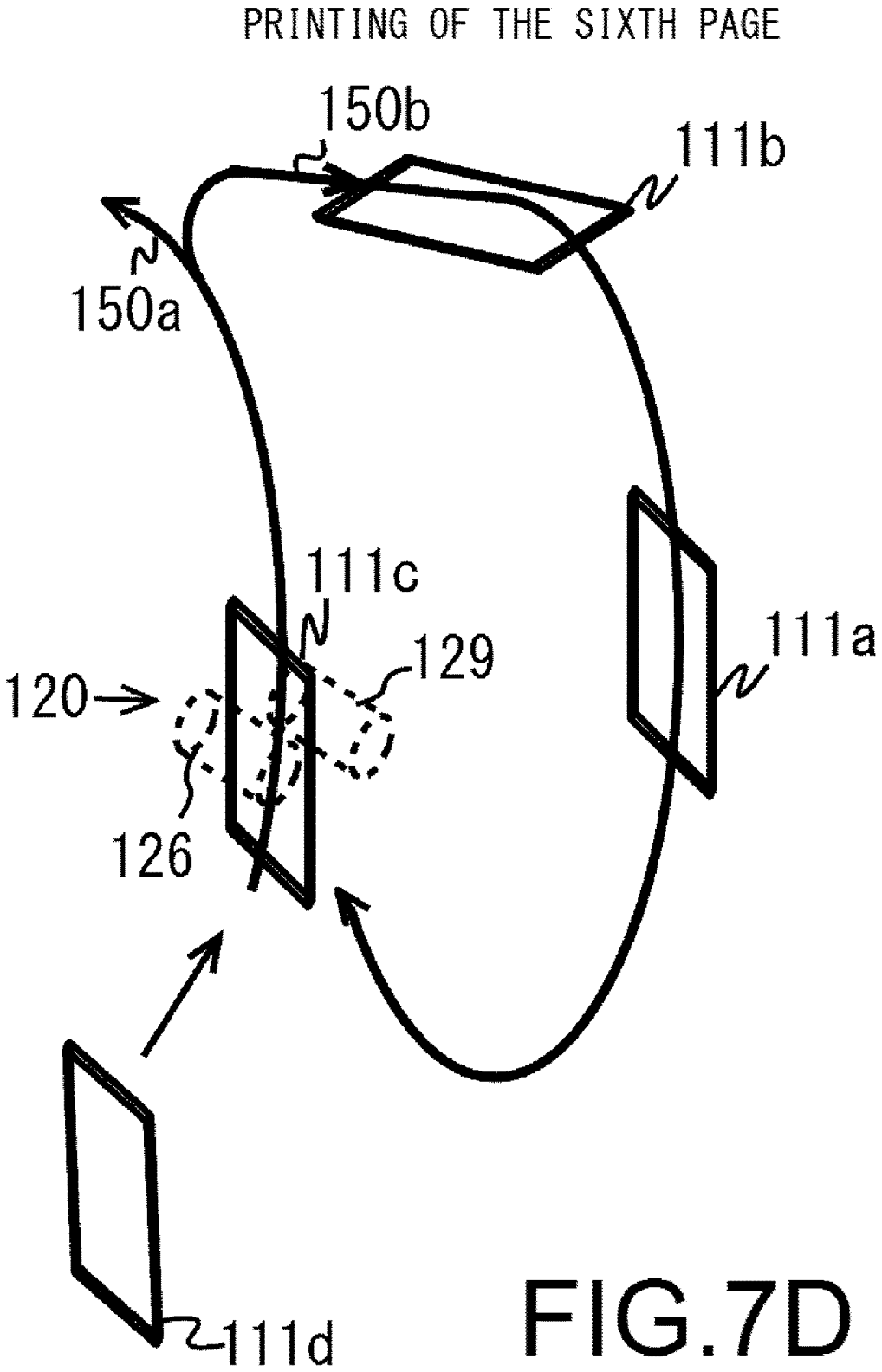
FIG. 7D explains the printing order in conditions for which a preceding job can be interrupted by a simple job, and illustrates the case in which the sixth page is printed.
Figure 7E:
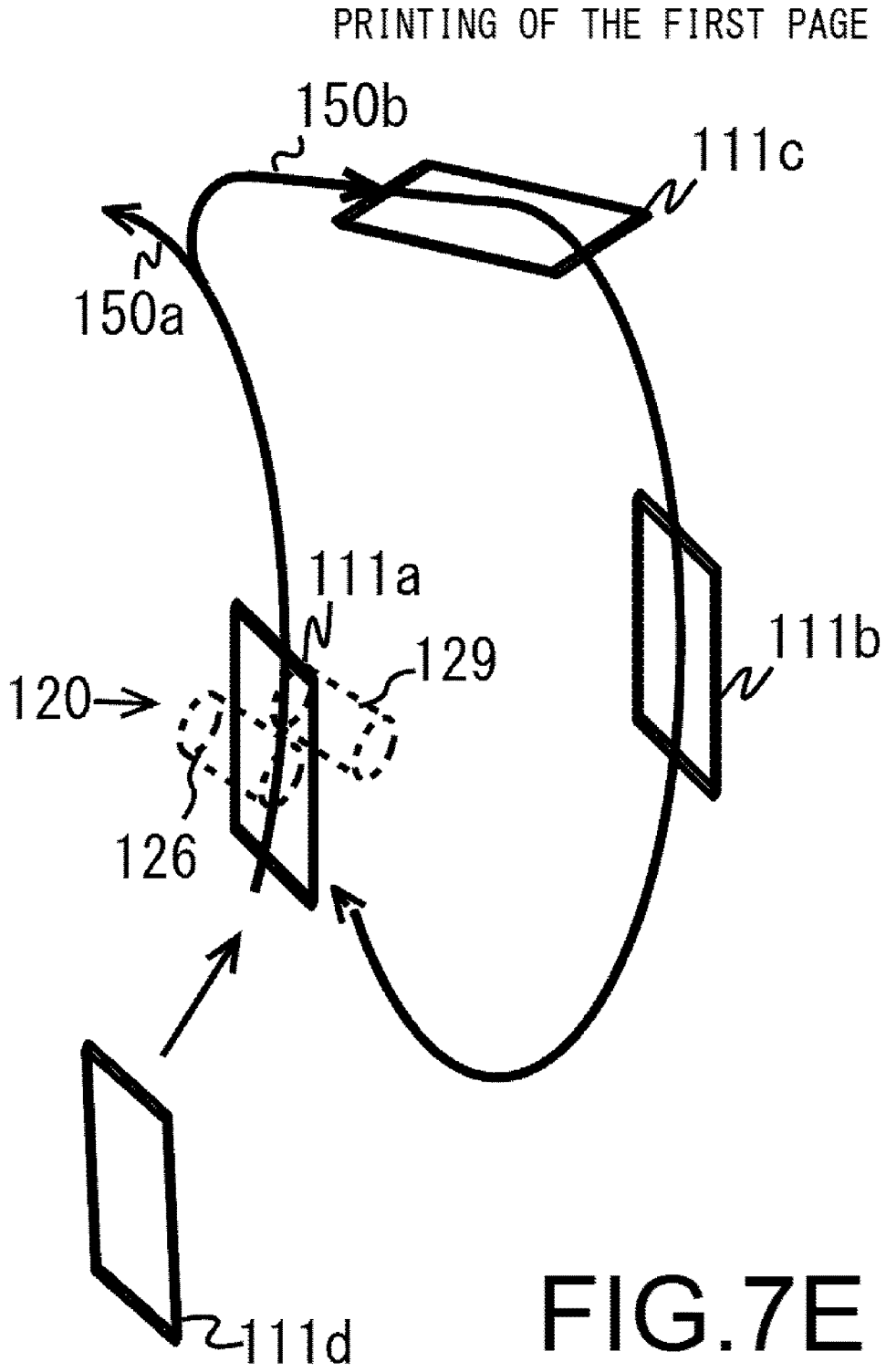
FIG. 7E explains the printing order in conditions for which a preceding job can be interrupted by a simple job, and illustrates the case in which the first page is printed.

In other words, as illustrated in FIG. 7B, after the second page is printed on the front surface of the first sheet of paper 111*a*, as illustrated in FIG. 7C, the first sheet of paper 111*a* is moved to the transporting path 150*b* side that branches off from the transporting path 150*a*. At the same time as this, the fourth page is printed on the front surface of the second sheet of paper 111*b*. Continuing, as illustrated in FIG. 7D, after the second sheet of paper 111*b* is moved to the transporting path 150*b* side, the sixth page is printed on the front surface of the third sheet of paper 111*c*. Next, as illustrated in FIG. 7E, at the same time that the third sheet of paper 111*c* is moved to the transporting path 150*b* side, the first sheet of paper 111*a* that has been turned over from front to back on the transporting path 150*b* is moved to the transporting path 150*a* side from the junction between the transporting path 150*a* and the transporting path 15*b*, and the first page is printed on the back surface of the paper 111*a*.

Figure 8F:
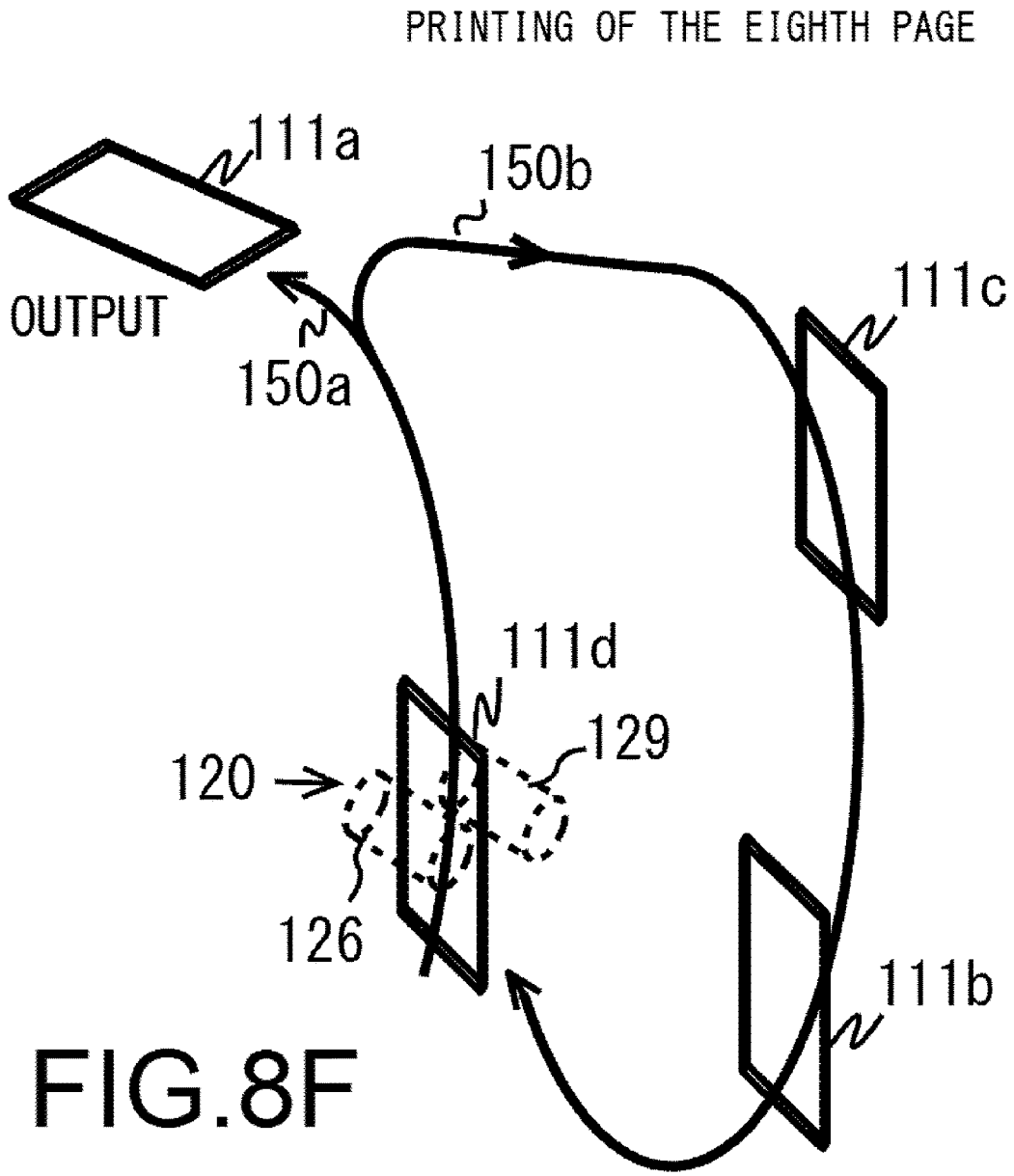
FIG. 8F explains the printing order in conditions for which a preceding job can be interrupted by a simple job, and illustrates the case in which the eighth page is printed.
Figure 8G:
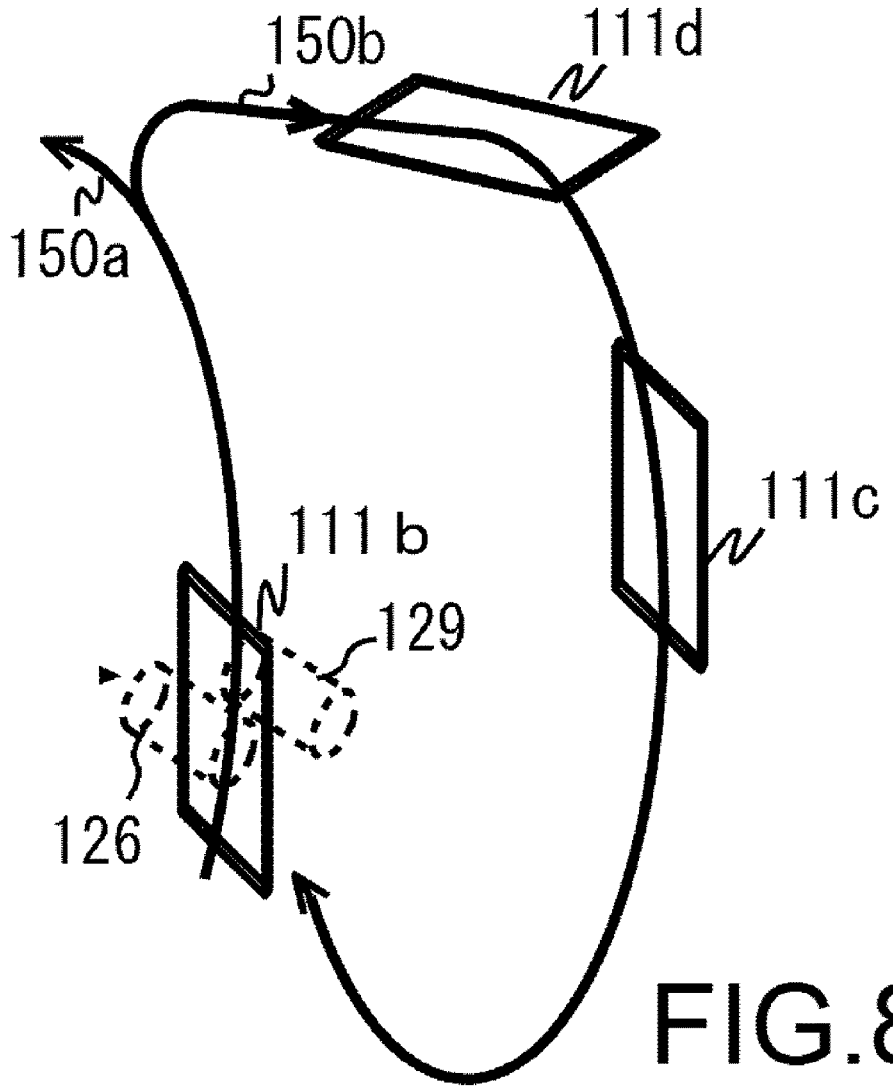
FIG. 8G explains the printing order in conditions for which a preceding job can be interrupted by a simple job, and illustrates the case in which the third page is printed.
Figure 8H:
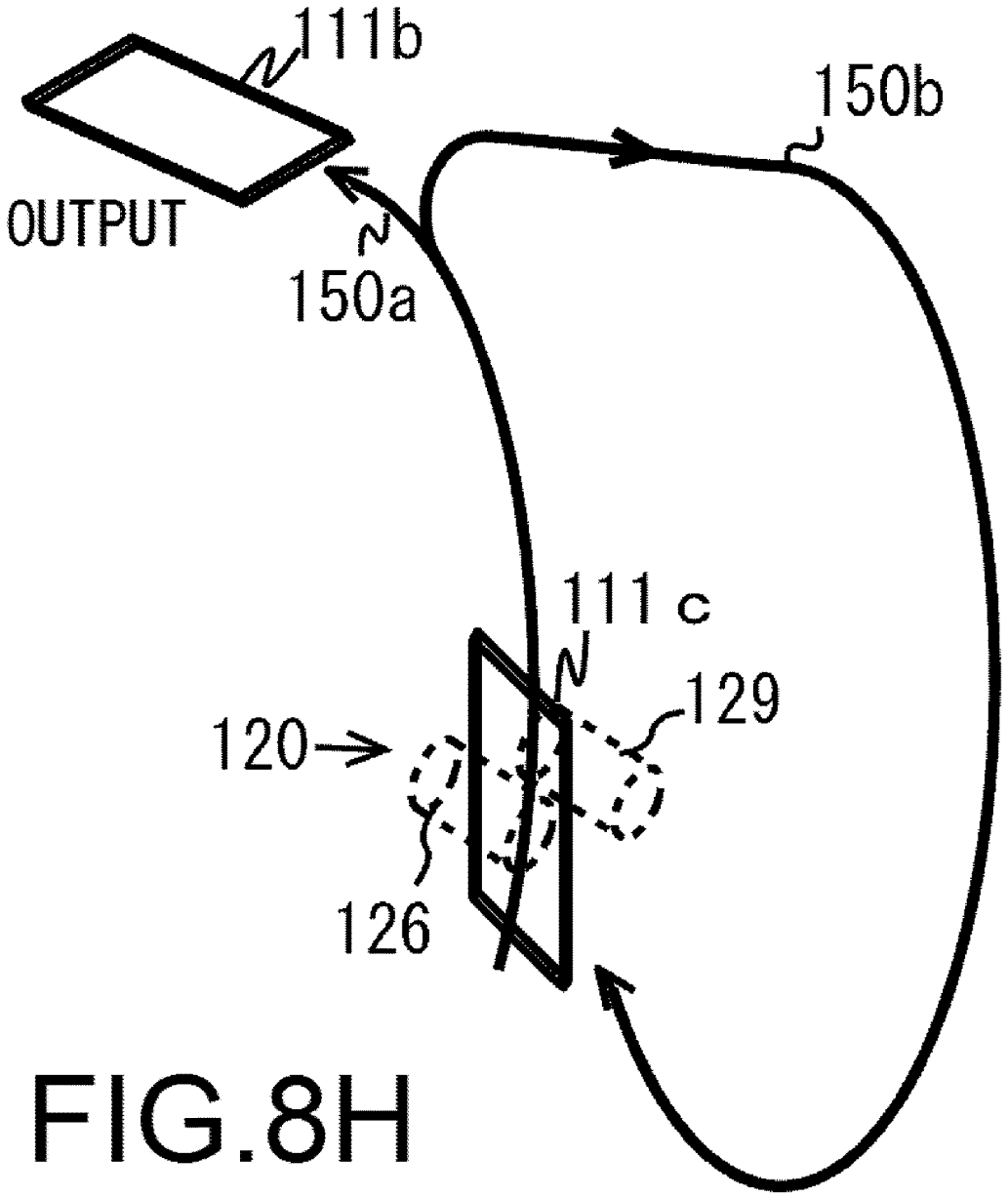
FIG. 8H explains the printing order in conditions for which a preceding job can be interrupted by a simple job, and illustrates the case in which the fifth page is printed.
Figure 8I:
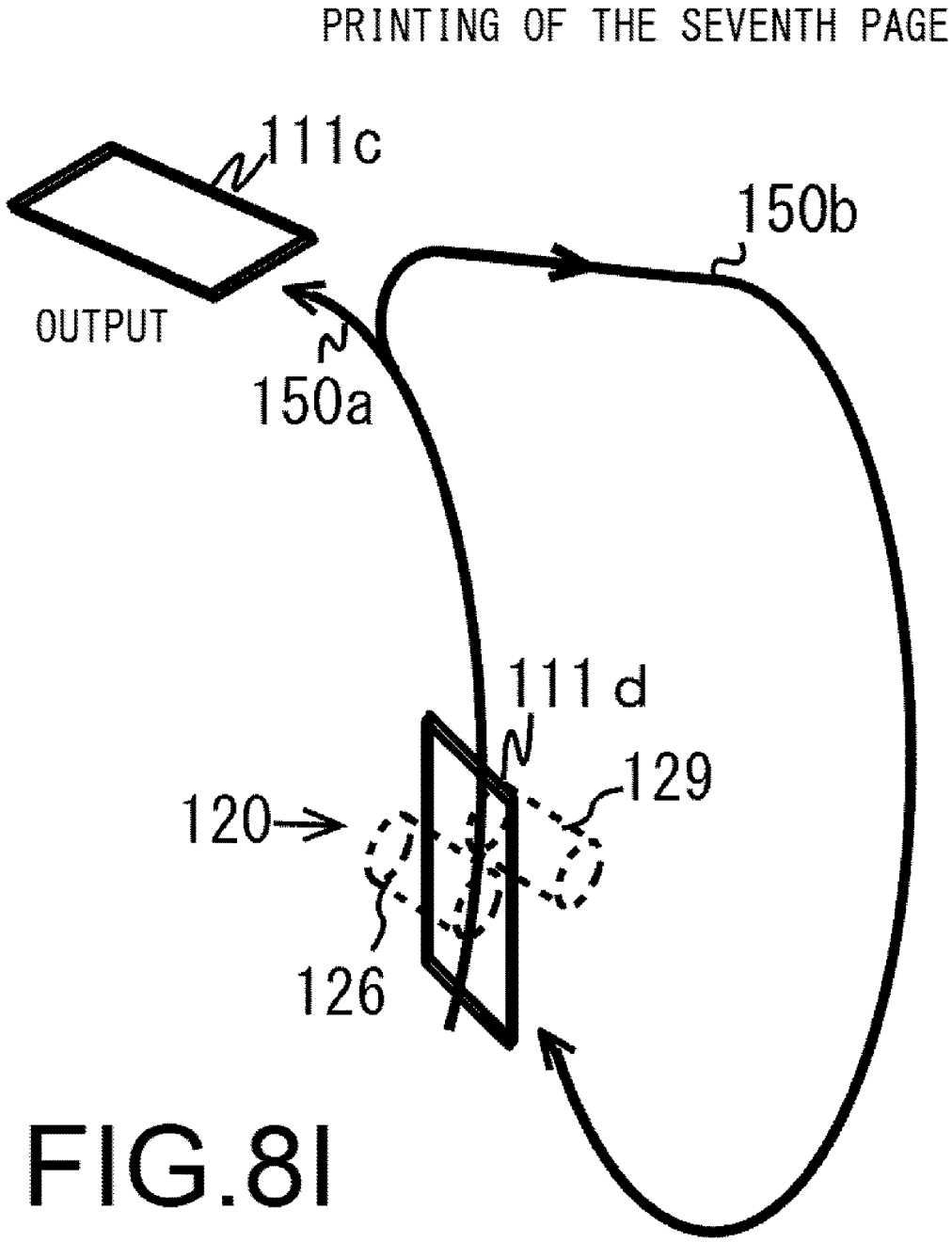
FIG. 8I explains the printing order in conditions for which a preceding job can be interrupted by a simple job, and illustrates the case in which the seventh page is printed and printing is finished.

Moreover, as illustrated in FIG. 8F, at the same time that the first sheet of paper 111*a* is outputted, the eighth page is printed on the front surface of the fourth sheet of paper 111*d*. After that, as illustrated in FIG. 8G, the third page is printed on the back surface of the second sheet of paper 111*b*, then as illustrated in FIG. 8H, the fifth page is printed on the back surface of the third sheet of paper 111*c*, and as illustrated in FIG. 8I, the seventh page is printed on the back surface of the fourth sheet of paper 111*d*, after which printing ends. In FIG. 8F, when the eighth page is printed on the front surface of the fourth sheet of paper 111*d*, the second sheet of paper 111*b* waits on the transporting path 150*b*, printing of the second sheet of paper 111*b* continues after printing of the fourth sheet of paper 111*d*, so the printing job is continuous without stopping.

Next, referring to FIGS. 9A to 9E, interrupt printing in a 4 Sheet Batch condition when the preceding job is 2-page double-sided printing will be explained. First, the paper 111A of a simple job interrupts and is inserted after the second page has been printed on the first sheet of paper 111*a*. In other words, as illustrated in FIG. 9B, after the second page is printed on the front surface of the first sheet of paper 111*a*, the first sheet of paper 111*a* is moved to the transporting path 150*b* side that branches off from the transporting path 150*a* as illustrated in FIG. 9C. At the same time as this, the image of the simple job is printed on the front surface of the paper 111A of the simple job. Continuing, as illustrated in FIG. 9D, at the same time that the paper 111A of the simple job is outputted, the first sheet of paper 111*a* that is turned over from front to back on the transporting path 150*b* is moved to the transporting path 150*a* side from the junction between the transporting path 150*a* and the transporting path 150*b*, and the first page is printed on the back surface of the paper 111*a*. Then, as illustrated in FIG. 9E, the first sheet of paper 111*a* is outputted and printing ends. As a result, interrupt printing on the paper 111A of the simple job is executed while the first sheet of paper 111*a* is on the transporting path 150*b*, so the job continues to the first sheet of paper 111*a* without stopping.

Figure 10A:
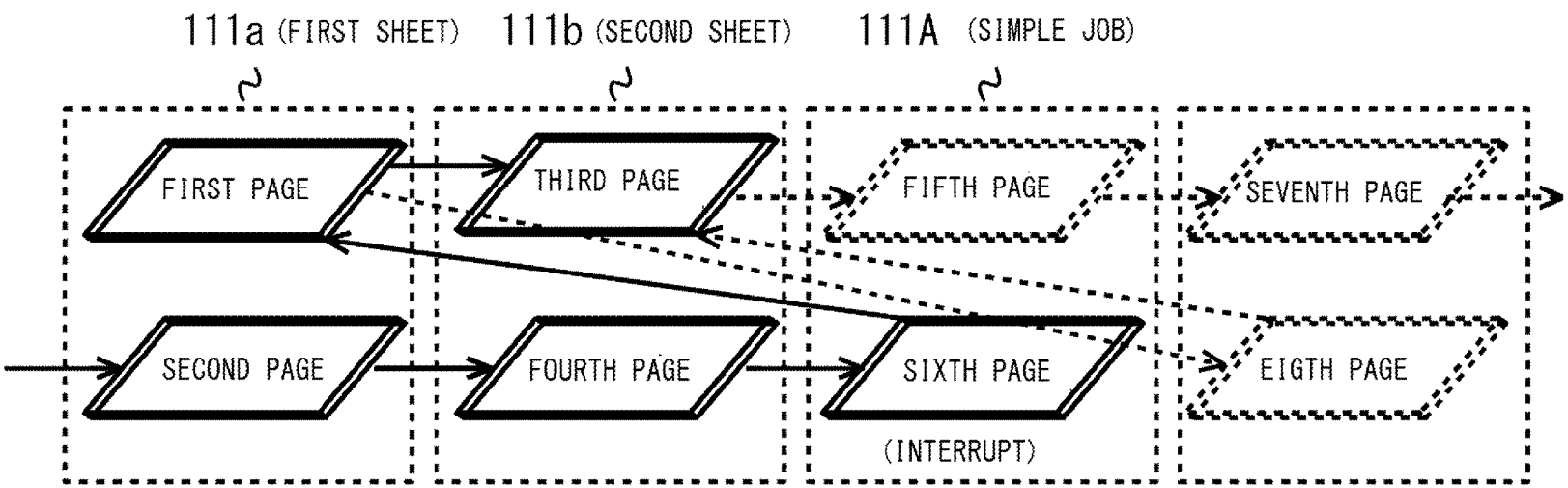
FIG. 10A explains interrupt printing for a 4-sheet batch condition when a preceding job is 4-page double-sided printing, and illustrates interrupt insertion of a simple job.
Figure 10B:
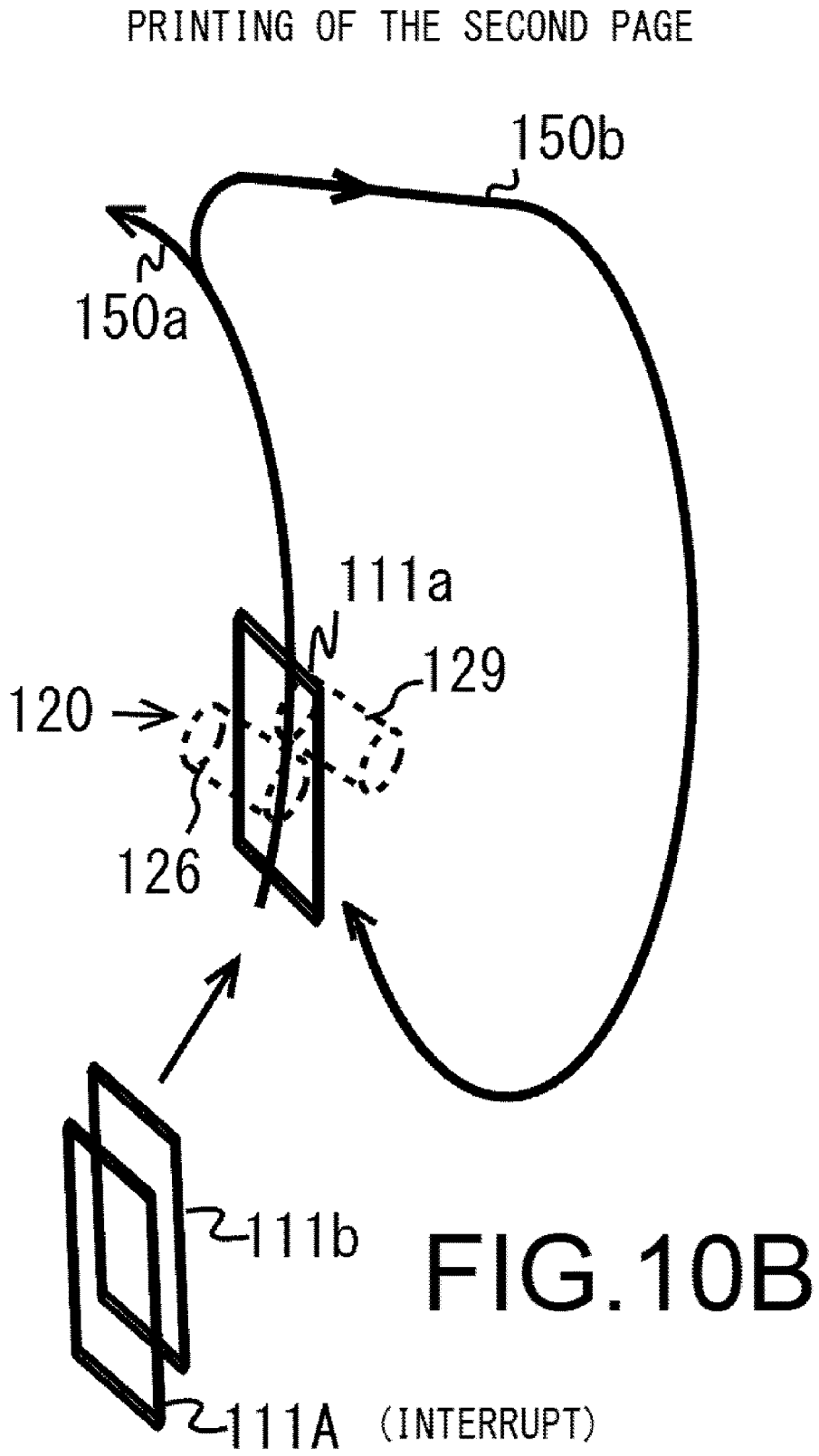
FIG. 10B explains interrupt printing for a 4-sheet batch condition when a preceding job is 4-page double-sided printing, and illustrates the case in which the second page is printed.
Figure 10C:
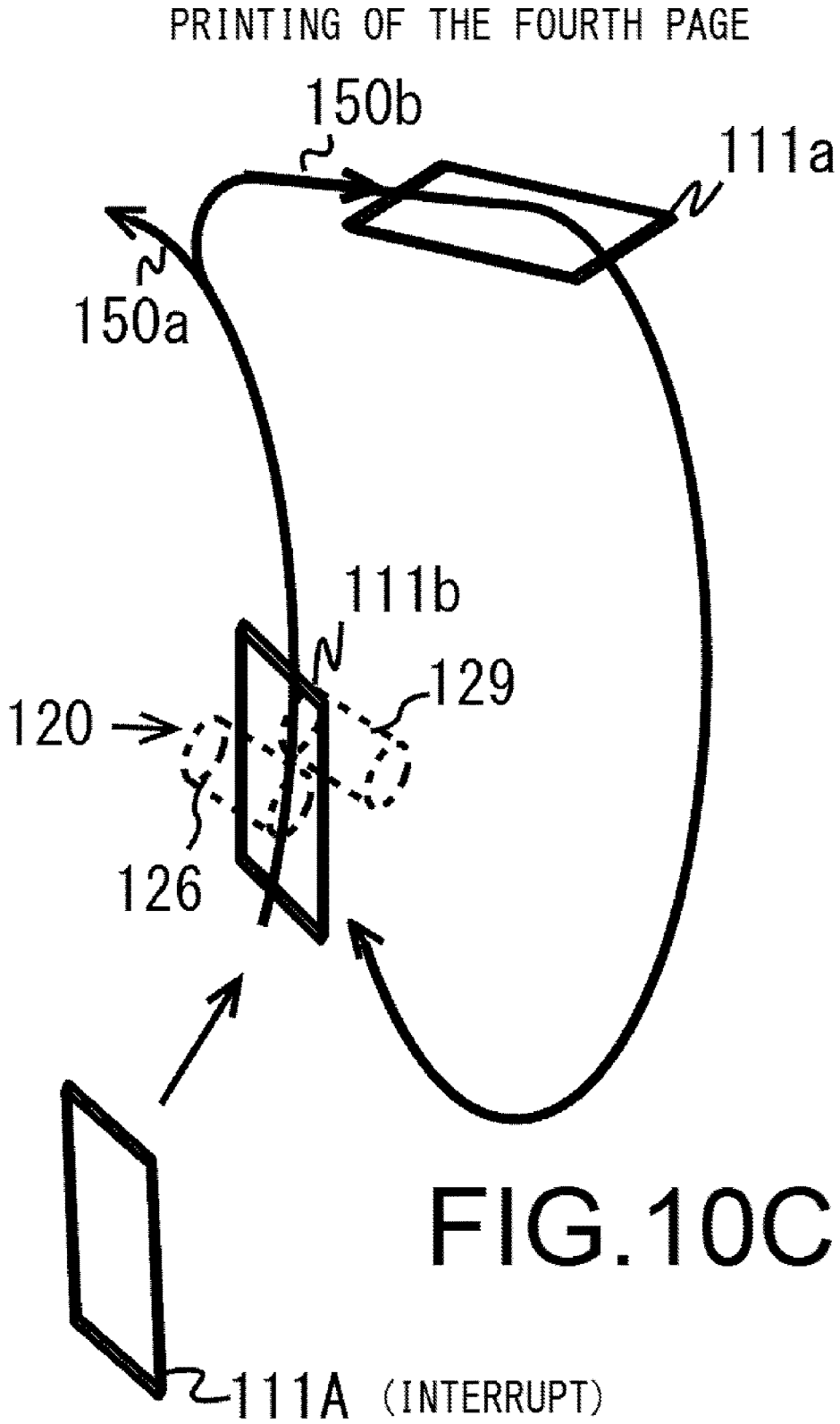
FIG. 10C explains interrupt printing for a 4-sheet batch condition when a preceding job is 4-page double-sided printing, and illustrates the case in which the fourth page is printed.
Figure 10D:
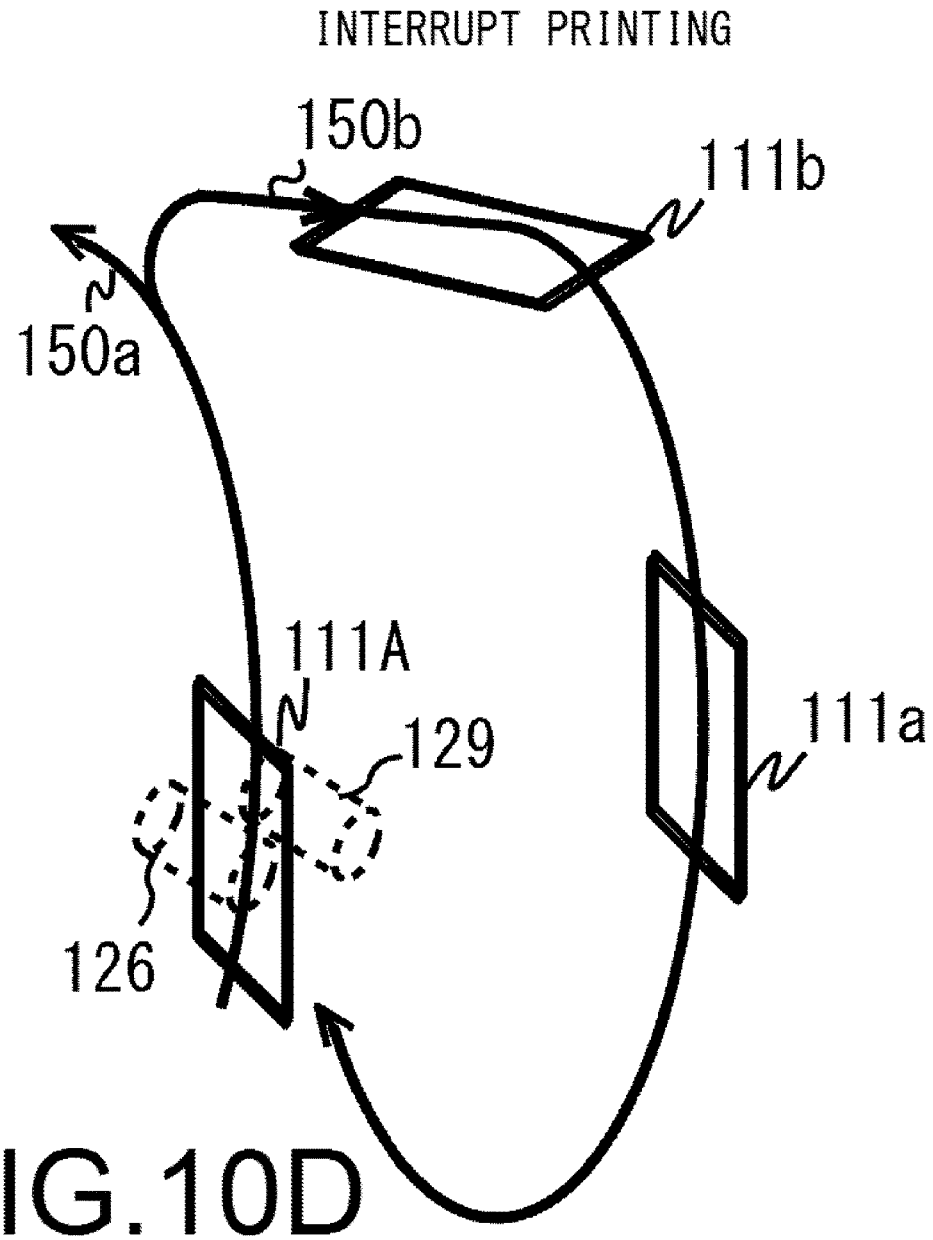
FIG. 10D explains interrupt printing for a 4-sheet batch condition when a preceding job is 4-page double-sided printing, and illustrates the case in which the image of a simple job is printed.

Next, referring to FIGS. 10A to 10E and FIGS. 11F and 11G, interrupt printing in a 4 Sheet Batch condition when the preceding job is 4-page double-sided printing will be explained. First, as illustrated in FIG. 10A, the printing paper 111A for a simple job interrupts and is inserted after the fourth page is printed on the second sheet of paper 111*b*. In other words, as illustrated in FIG. 10B, after the second page is printed on the front surface of the first sheet of paper 111*a*, the first sheet of paper 111*a* is moved to the transporting path 150*b* side as illustrated in FIG. 10C. At the same time as this, after the fourth page is printed on the front surface of the second sheet of paper 111*b*, the second sheet of paper 111*b* is moved to the transporting path 150*b* side as illustrated in FIG. 10D. At the same time as this, the simple job is printed on the front surface of the paper 111A for the simple job.

Figure 10E:
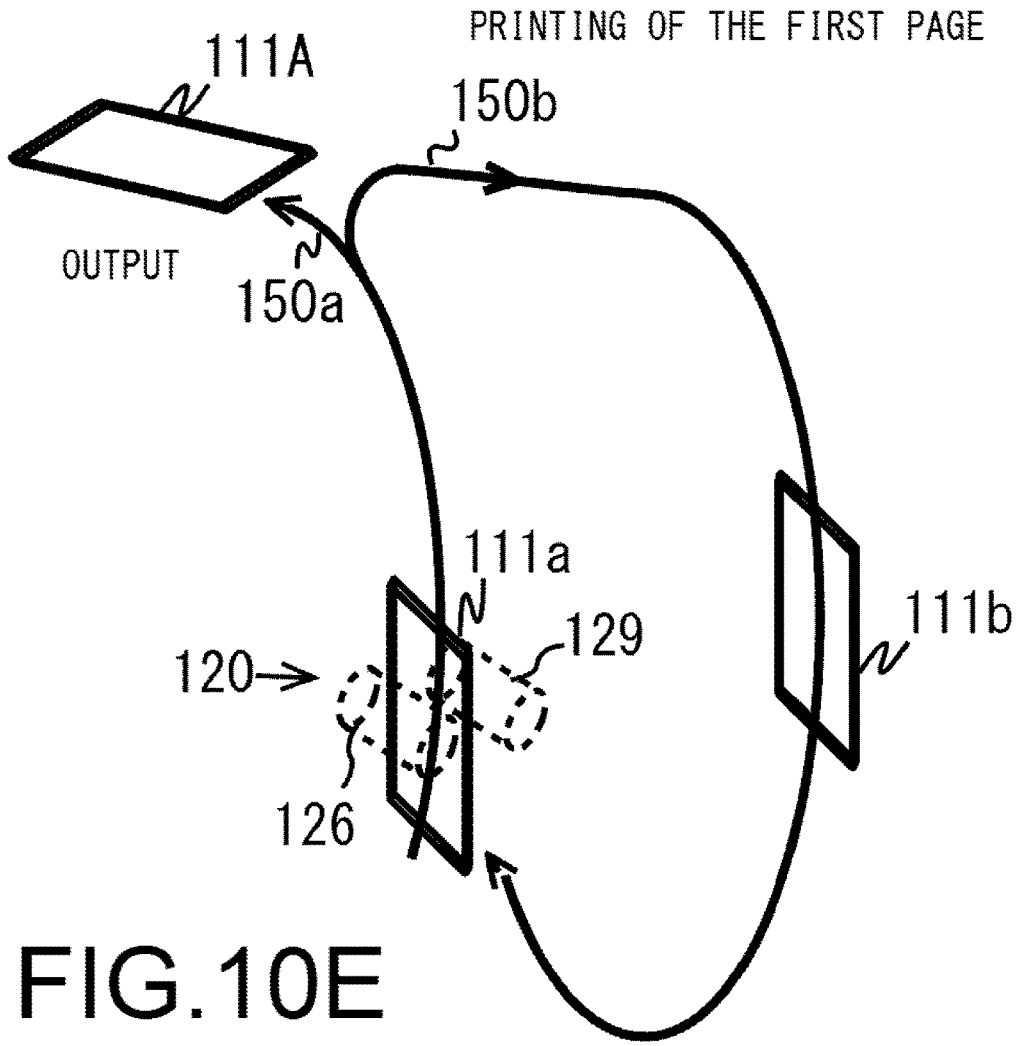
FIG. 10E explains interrupt printing for a 4-sheet batch condition when a preceding job is 4-page double-sided printing, and illustrates the case in which the first page is printed.
Figure 11F:
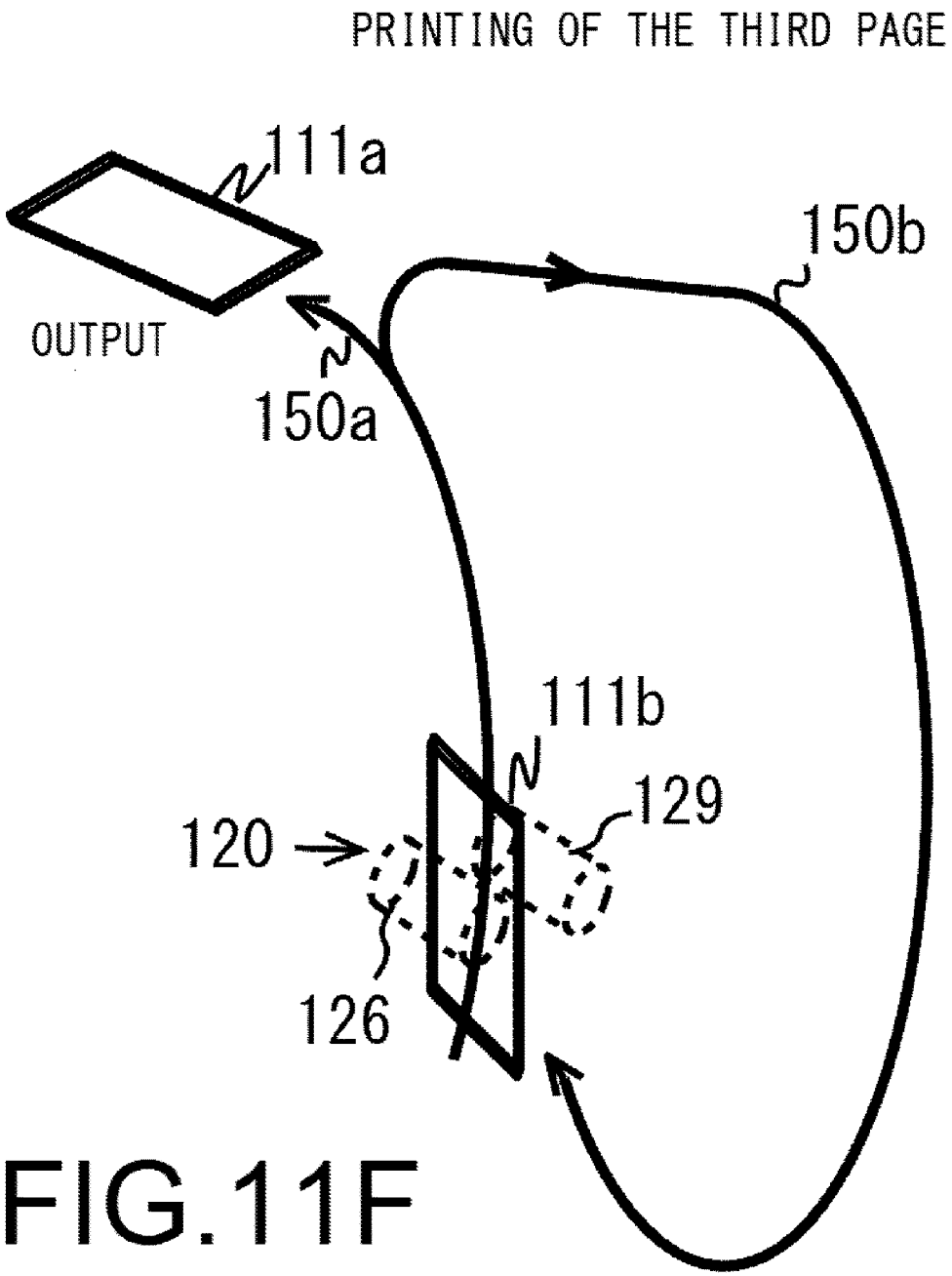
FIG. 11F explains interrupt printing for a 4-sheet batch condition when a preceding job is 4-page double-sided printing, and illustrates the case in which the third page is printed.
Figure 11G:
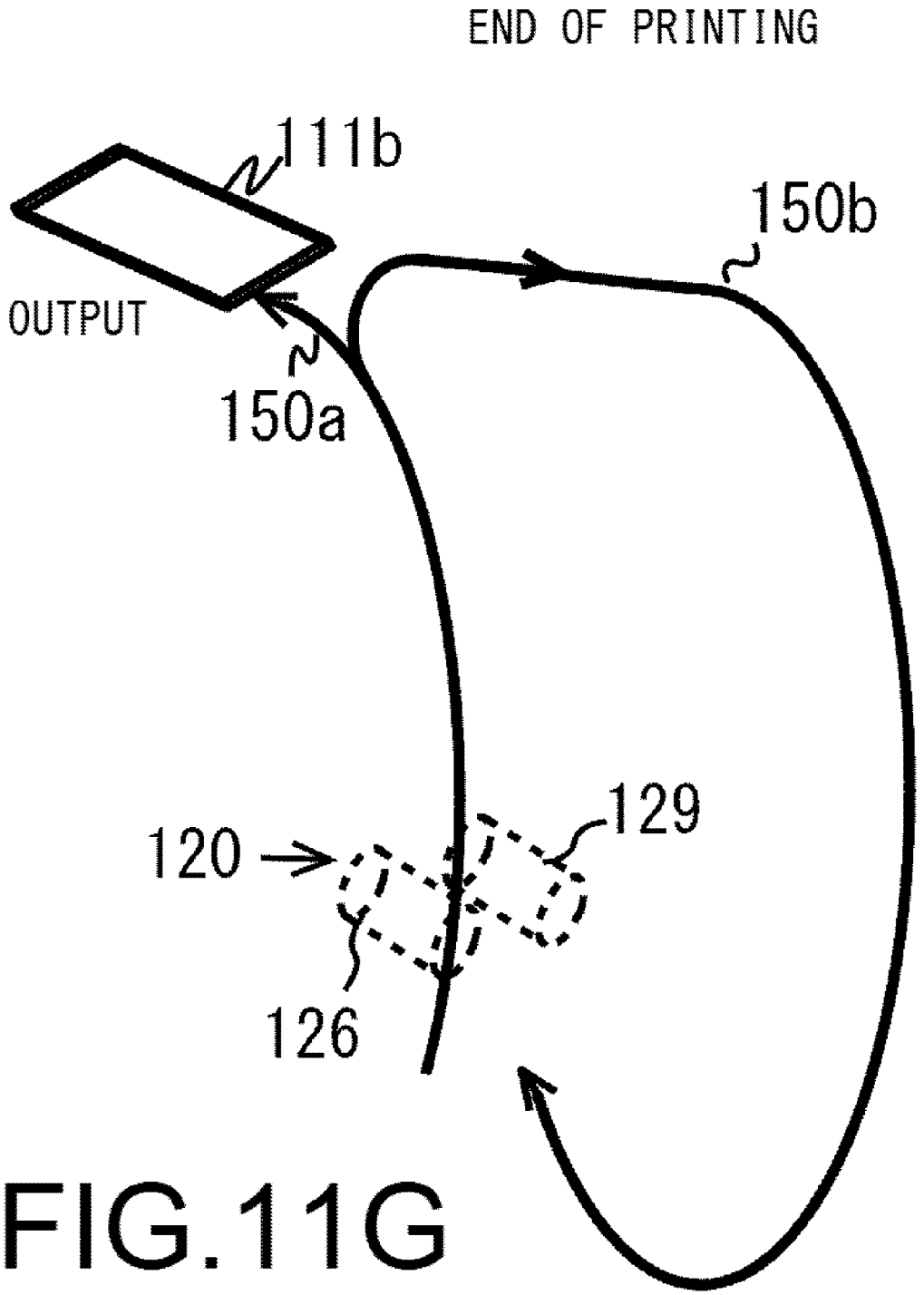
FIG. 11G explains interrupt printing for a 4-sheet batch condition when a preceding job is 4-page double-sided printing, and illustrates the case in which printing is finished.

Continuing, as illustrated in FIG. 10E, at the same time that the paper 111A for the simple job is outputted, the first sheet of paper 111*a* that is turned over from front to back is moved to the transporting path 150*a*, and the first page is printed on the back surface of the first sheet of paper 111*a*. Moreover, as illustrated in FIG. 11F, at the same time that the first sheet of paper 111*a* is outputted, the third page is printed on the back surface of the second sheet of paper 111*b*, after which as illustrated in FIG. 11G, the second sheet of paper 111*b* is outputted and printing ends. As a result, as illustrated in FIG. 10D, when the first sheet of paper 111*a* and the second sheet of paper 111*b* are on the transporting path

150*b*, interrupt printing on the paper 111A of the simple job is executed, so processing of the preceding job continues without being stopped.

The printing order in a 4 Sheet Batch condition when the preceding job is 2-page double-sided printing and a simple job that is 2-page single-sided printing interrupts becomes: the second page to the simple job (interrupt for the first page) to the simple job (interrupt for the second page) to the first page. As described above, after the front surface of the last sheet of paper 111 of a preceding job that is double-sided printing (in other words, the last sheet of paper 111 that is supplied to the transporting path 150*a* of the sheets of paper 111 that are used in the printing of the preceding job, for example, the first sheet in the case of 2-page double-sided printing in a 4 Sheet Batch, or the second sheet in the case of 4-page double-sided printing) is printed and until the back surface of the first sheet of paper 111 of the preceding job (in other words, the first page of the preceding job) is printed, new paper 111 that is not used for printing of the preceding job can be supplied to the transporting path 150*a*, and the number of pages of single-sided printing that can be printed can interrupt as a simple job. In other words, when the number of sheets of printing of a preceding job that is double-sided printing (half of the number of pages) is less than the number of sheets of paper 111 that can be transported at the same time on the portion of the transporting path 150*a* from the junction with the transporting path 150*b* to the branching point and on the transporting path 150*b* (except for the sheets of paper 111 that have passed the transfer unit after being turned over from front to back (portion where the secondary transfer roller 129 faces the intermediate transfer belt 128)), it is possible for a simple job that is single-sided printing to interrupt when less than the number of sheets obtained by subtracting the number of sheet of printing of the preceding job from the number of sheets of paper 111 that can be transported at the same time.

This also the same for a transporting path that is a 5 Sheet Batch or greater, or in other words, for a transporting pattern in which the number of sheets of paper 111 that can be newly supplied to the transporting path 150*a* after printing on the front surface of the first sheet of printing paper 111 (in other words, the second page of the preceding job) and until printing the back surface of the first sheet of paper 111 (in other words, the first page of the preceding job) is three sheets or more. The system-control unit 180, based on conditions such as described above under which a simple job can be printed, sets the printing order so that printing of simple job is performed. More specifically, when a simple job can interrupt a preceding job, the system-control unit 180 sets the printing order so that after the last printing paper 111 that is used for printing of the preceding job is supplied to the transporting path 150*a*, the new printing paper 111 that is used for printing of the simple job is supplied to the transporting path 150*a* and printed.

However, in the case of a 2 Sheet Batch, after printing on the front surface of the (2n−1)th sheet of paper 111 (n is a positive integer) (in other words, the (4n−2)th page of the preceding job) and until the printing of the back surface of the (2n−1)th sheet of paper 111 (in other words the (4n−3)th page of the preceding job), the number of pages of new paper 111 for single-sided printing that can be supplied to the transporting path 150*a* and printed can interrupt as a simple job. Here, the printing order in a 2 Sheet Batch condition becomes: the second page to the fourth page to the first page to the third page to the sixth page to the eighth page to the fifth page to the seventh page and so on. For example, in a 2 Sheet Batch condition when the preceding job is 2-page double-sided printing, the printing order when a simple job that is 2-page single-sided printing interrupts becomes: the second page to the simple job (interrupt) to the first page. Moreover, in a 2 Sheet Batch condition when the preceding job is 6-page double-sided printing, the printing order when a simple job that is 2-page single-sided printing becomes: the second page to the fourth page to the first page to the third page to the sixth page to the simple job (interrupt) to the fifth page.

Figure 12:
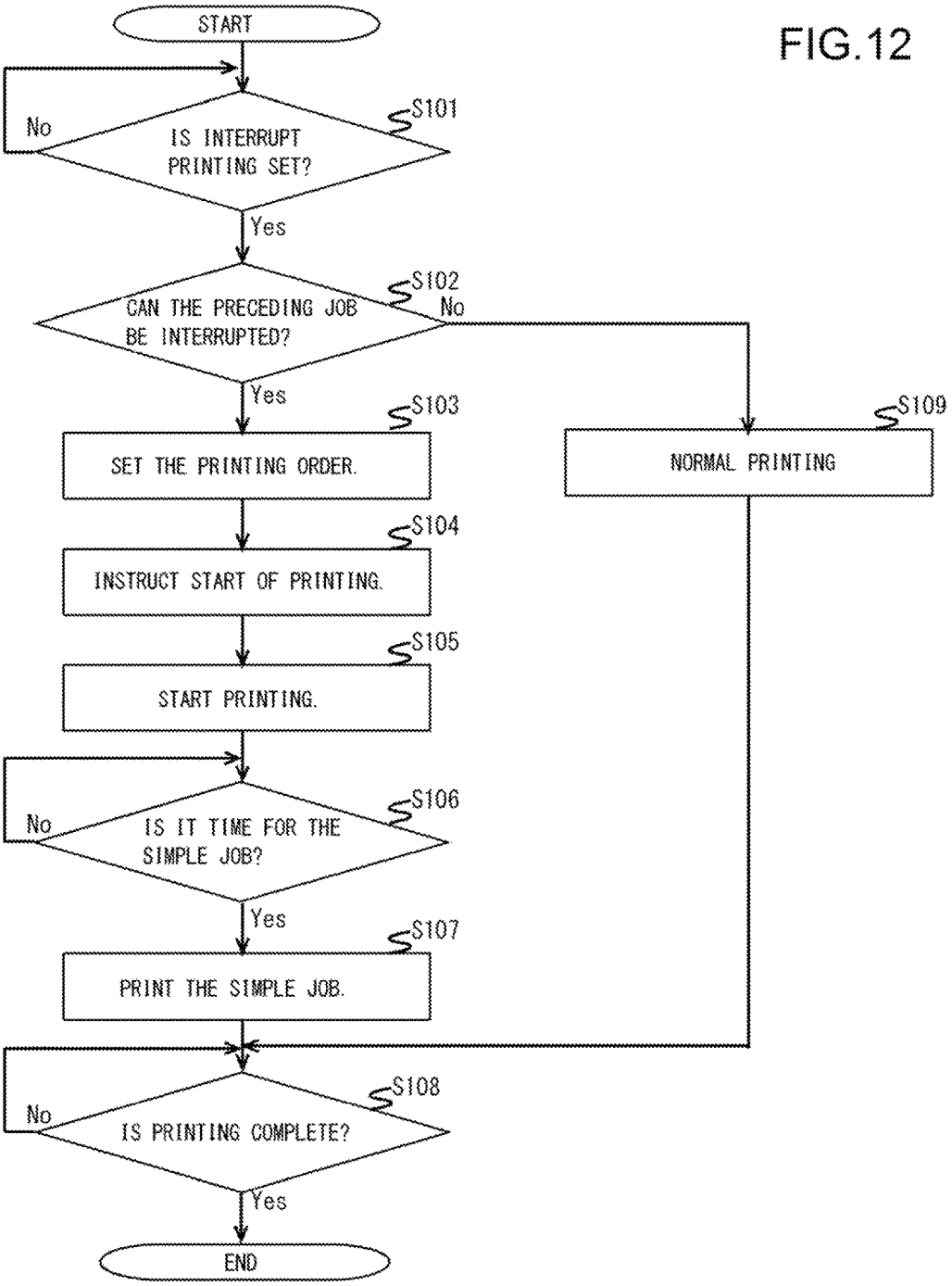
FIG. 12 illustrates the steps of an interrupt printing process by the MFP in FIG. 1.

Next, referring to FIG. 12, interrupt processing by the MFP 100 will be explained. In the following, the case of interrupt printing of a simple job after a preceding job will be explained.

(Step S101)

The system-control unit 192 determines whether or not interrupt printing is set.

In this case, the system-control unit 192 waits for a notification from the panel-operation control unit 190 (step S101: NO), and when a notification indicating that interrupt printing is set is received from the panel-operation control unit 190, the system-control unit 192 determines that interrupt printing is set (step S101: YES), and moves to step S102.

(Step S102)

The system-control unit 192 references the condition table described above that gives the conditions for a preceding job for which interrupt by a simple job is possible, and determines whether or not the preceding job can be interrupted.

In this case, when the preceding job is a 1 Sheet Batch, the system-control unit 192 determines that interrupt by a simple job is not possible (step S102: NO), and moves to step S109.

However, when the preceding job is a 3 Sheet Batch, the system-control unit 192 determines that interrupt by a simple job is possible (step S102: YES), and moves to step S103.

(Step S103)

The system-control unit 192 sets the printing order for the simple job. In this case, as illustrated in FIG. 6A for example, in a 3 Sheet Batch condition when the preceding job is a 2-page double-sided printing, the system-control unit 192 sets the printing order so that simple job interrupts after the second page of the preceding job is printed.

Figure 9A:
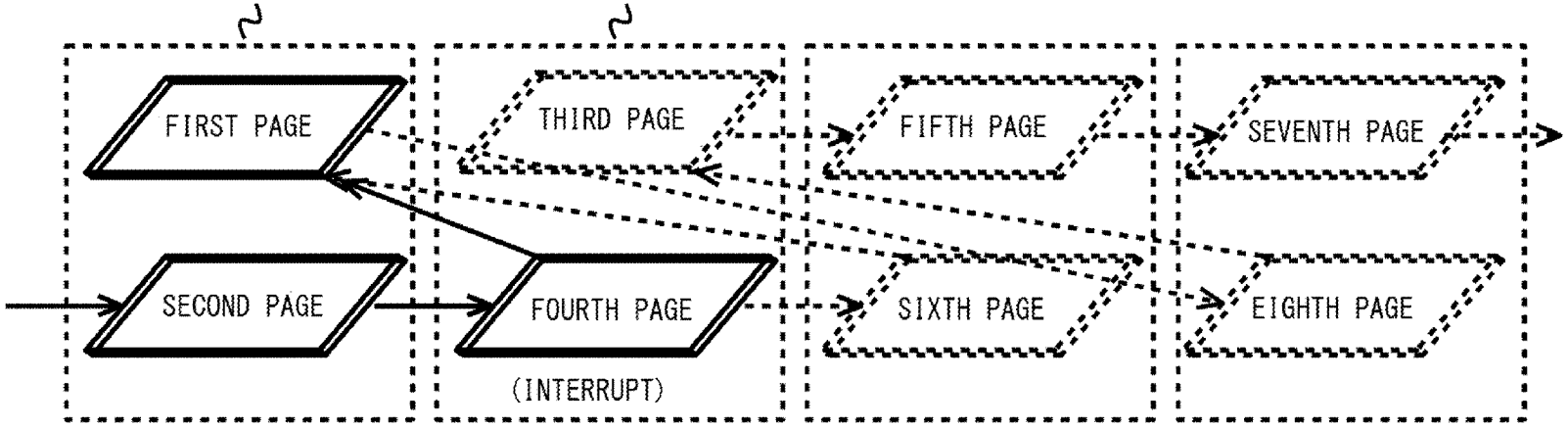
FIG. 9A explains interrupt printing for a 4-sheet batch condition when a preceding job is 2-page double-sided printing, and illustrates interrupt insertion of a simple job.
Figure 9B:
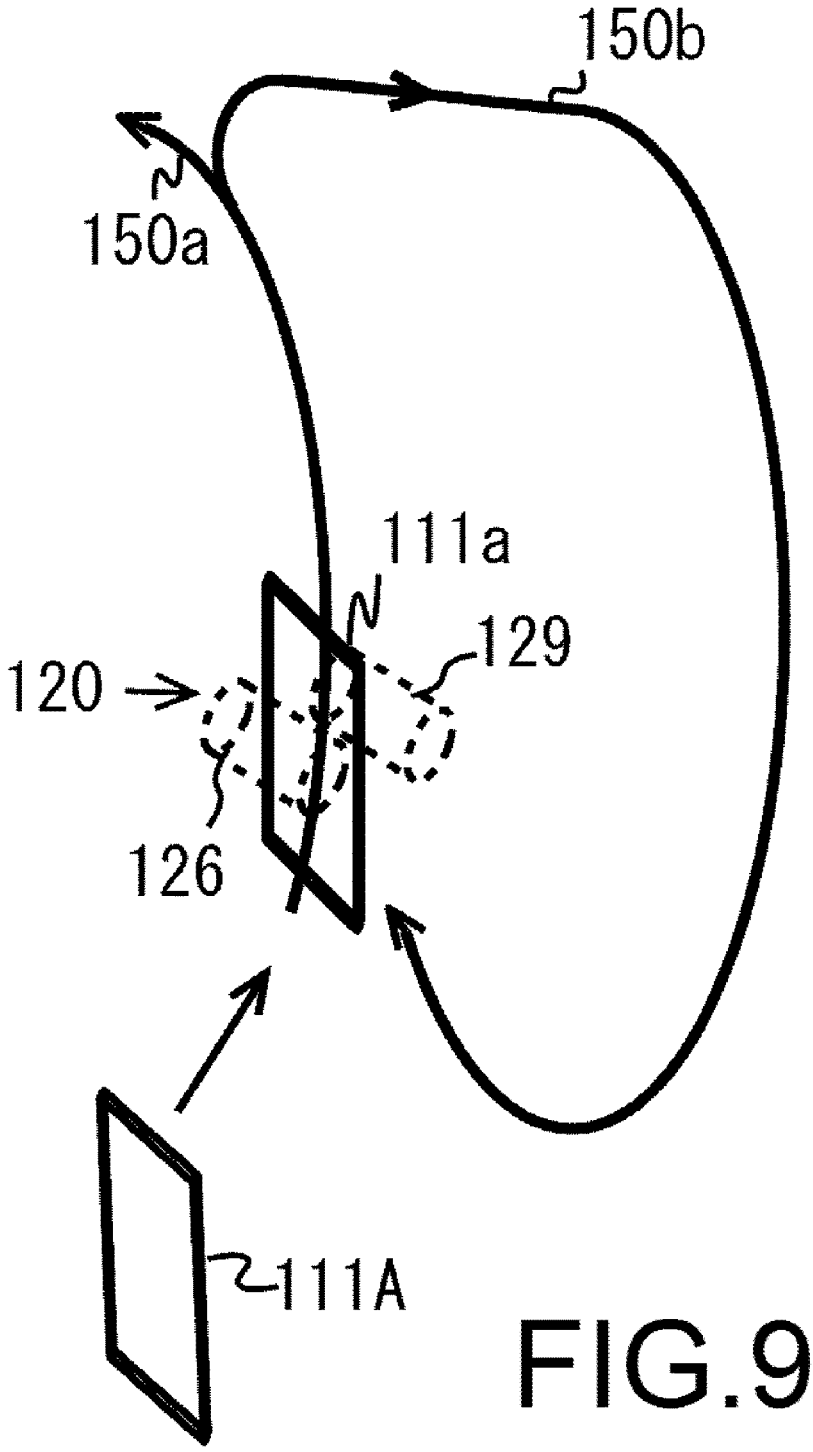
FIG. 9B explains interrupt printing for a 4-sheet batch condition when a preceding job is 2-page double-sided printing, and illustrates the case in which the second page is printed.
Figure 9C:
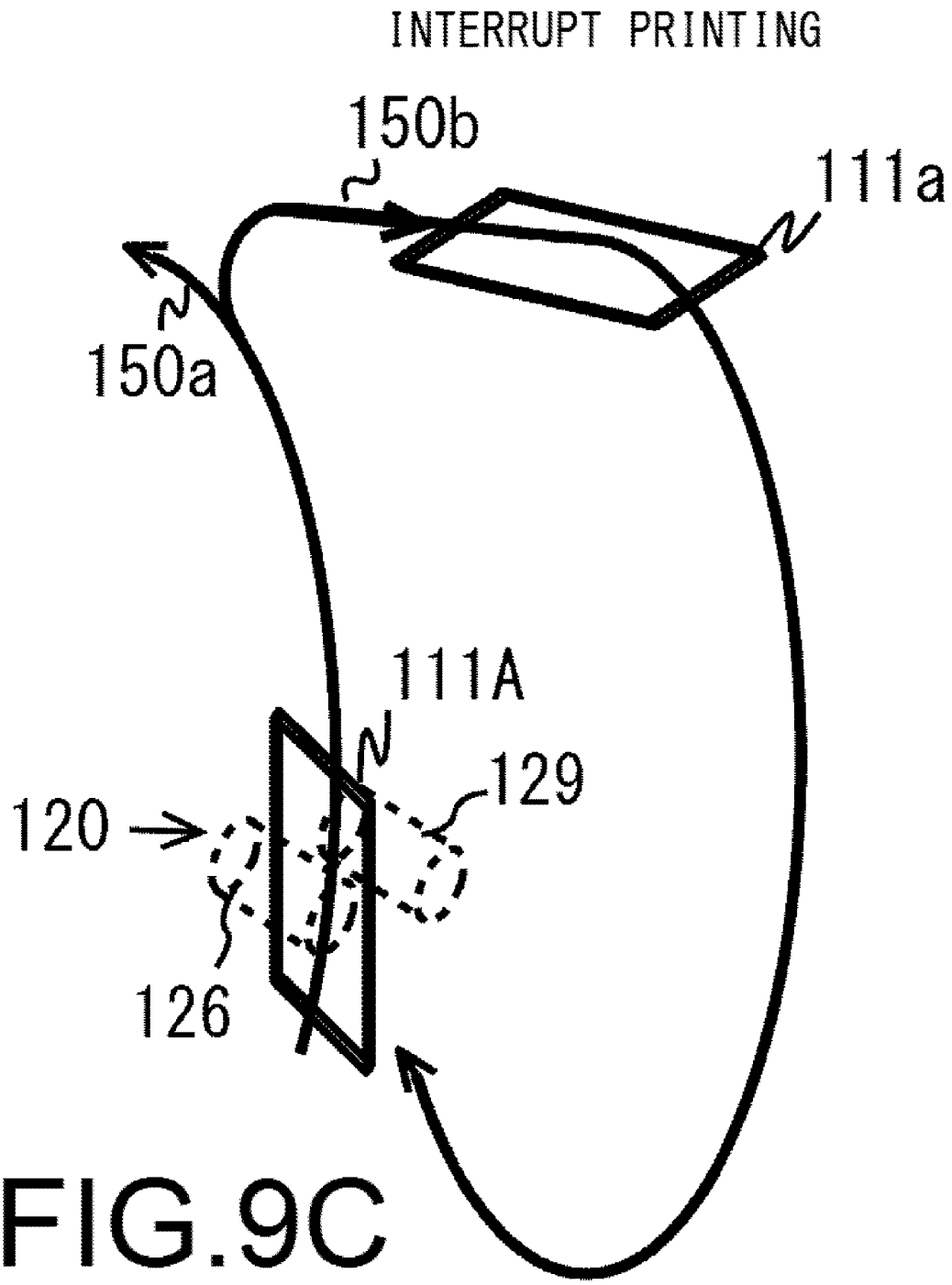
FIG. 9C explains interrupt printing for a 4-sheet batch condition when a preceding job is 2-page double-sided printing, and illustrates the case in which an image of a simple job is printed.
Figure 9D:
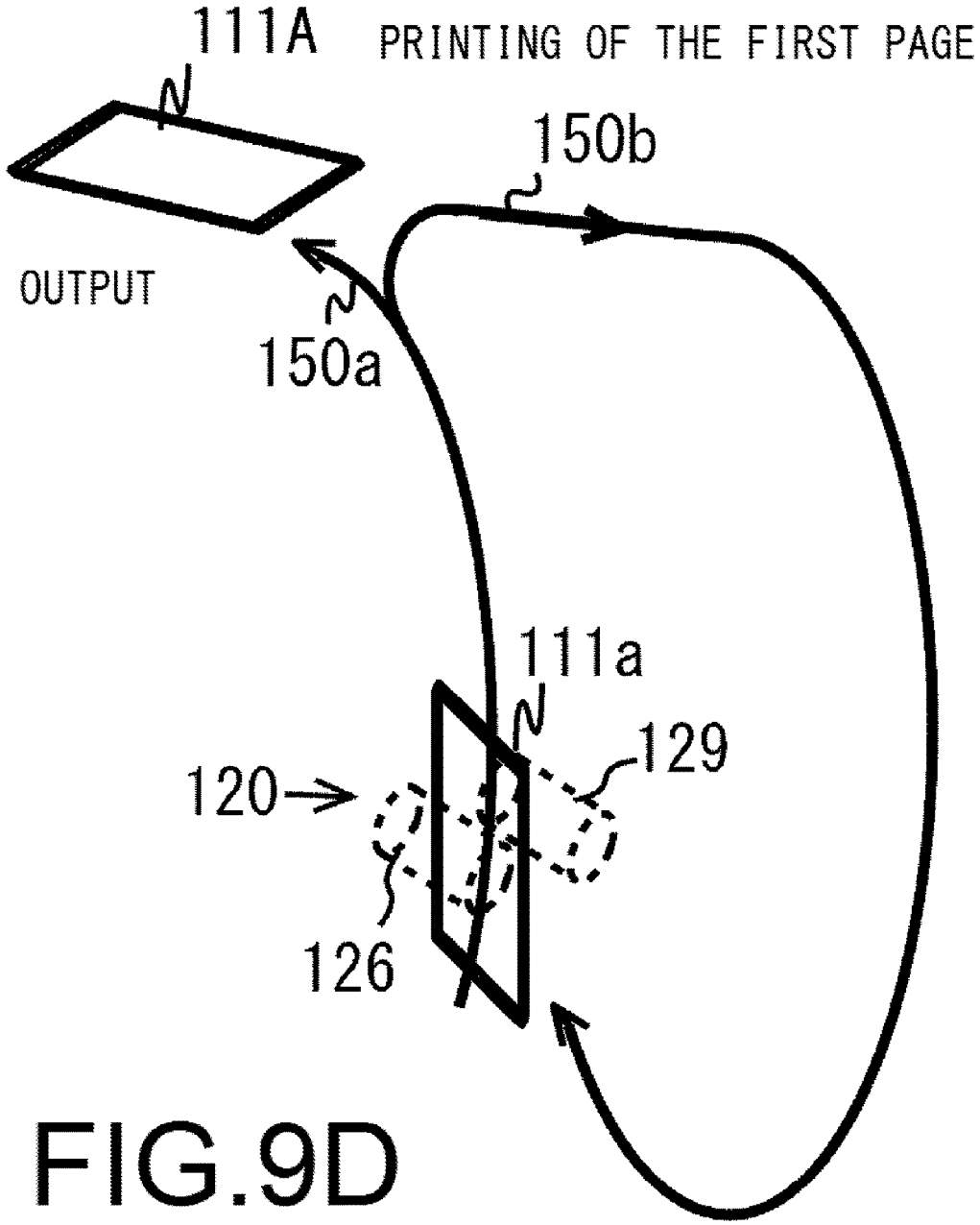
FIG. 9D explains interrupt printing for a 4-sheet batch condition when a preceding job is 2-page double-sided printing, and illustrates the case in which the first page is printed.
Figure 9E:
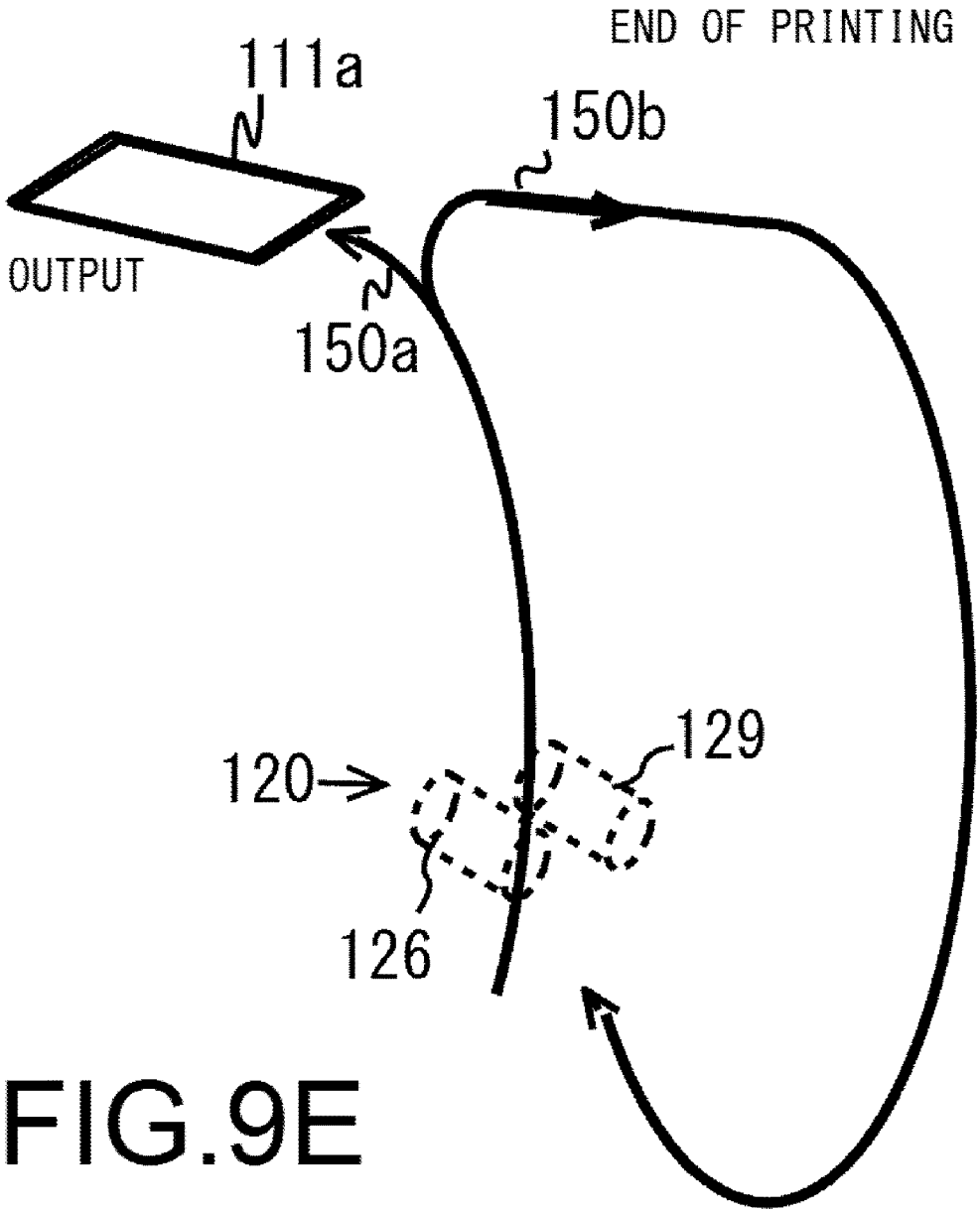
FIG. 9E explains interrupt printing for a 4-sheet batch condition when a preceding job is 2-page double-sided printing, and illustrates the case in which printing is finished.

Moreover, as illustrated in FIG. 9A for example, in a 4 Sheet Batch condition when the preceding job is 2-page double-sided printing, the system-control unit 192 sets the printing order so that the simple job interrupts after the second page of the preceding job is printed.

Furthermore, as illustrated in FIG. 10A for example, in a 4 Sheet Batch condition when the preceding job is 4-page double-sided printing, the system-control unit 192 sets the printing order so that the simple job interrupts after the fourth page of the preceding job is printed.

(Step S104)

After setting the printing order of the simple job, the system-control unit 192 gives an instruction to start printing.

In this case, the system-control unit 192 gives an instruction to the image-processing unit 187 to perform image processing for the preceding job and the simple job. After printing data that has undergone image processing by the image-processing unit 187 is stored in the RAM 185, the system-control unit 192 gives an instruction to the transporting-control unit 189 to transport paper 111, and gives an instruction to the printer-control unit 182 to print.

(Step S105)

The printer-control unit 182 starts printing on the paper 111 based on the printing data that is stored in the RAM 185.

(Step S106)

The system-control unit 192 determines whether or not it is time for the simple job.

Here, as illustrated in FIG. 6A for example, in a 3 Sheet Batch condition when the preceding job is 2-page double-sided printing, the system-control unit 192, determines that it is not the time for the simple job when the second page is being printed on the front surface of the first sheet of paper 111*a* as illustrated in FIG. 6B (step S106: NO).

However, when printing of the second page on the front surface of the first sheet of paper 111*a* is finished as illustrated in FIG. 6C, the system-control unit 192 determines that it is time for the simple job (step S106: YES), and moves to step S107.

Moreover, in a 4 Sheet Batch condition when the preceding job is 2-page double-sided printing as illustrated in FIG. 9A for example, the system-control unit 192 determines that it is not time for the simple job when the second page is being printed on the front surface of the first sheet of paper 111*a* as illustrated in FIG. 9B (step S106: NO).

However, when printing of the second page on the front surface of the first sheet of paper 111*a* is finished as illustrated in FIG. 9C, the system-control unit 192 determines that it is time for the simple job (step S106: YES), and moves to step S107.

Furthermore, in a 4 Sheet Batch condition when the preceding job is 4-page double-sided printing as illustrated in FIG. 10A for example, the system-control unit 192 determines that it is not time for the simple job when the second page is being printed on the front side of the first sheet of paper 111*a* as illustrated in FIG. 10B, and when the fourth page is being printed on the front surface of the second sheet of paper 111*b* as further illustrated in FIG. 10C (step S106: NO).

However, after printing of the fourth page on the front surface of the second sheet of paper 111*b* is finished as illustrated in FIG. 10D, the system-control unit 192 determines that it is time for the simple job (step S106: YES), and moves to step S107.

(Step S107)

The system-control unit 192 gives an instruction to print the simple job. Here, as illustrated in FIG. 6A for example, in a 3 Sheet Batch condition when the preceding job is 2-page double-sided printing, after the first sheet of paper 111*a* for which printing is complete is moved to the transporting path 150*b* side as illustrated in FIG. 6C, the system-control unit 192 executes printing on the paper 111A of the simple job.

Moreover, as illustrated in FIG. 9A for example, in a 4 Sheet Batch condition when the preceding job is 2-page double-sided printing, after the first sheet of paper 111*a* for which printing is complete is moved to the transporting path 150*b* side as illustrated in FIG. 9C, the system-control unit 192 executes printing on the paper 111A of the simple job.

Furthermore, as illustrated in FIG. 10A for example, in a 4 Sheet Batch condition when the preceding job is 4-page double-sided printing, after the second sheet of paper 111*b* for which printing is complete is moved to the transporting path 150*b* side as illustrated in FIG. 10D, the system-control unit 192 executes printing on the paper 111A of the simple job.

(Step S108)

The system-control unit 192 determines whether or not printing is complete. In this case, the system-control unit 192 determines that printing is not complete when there is no printing-complete notification from the printer-control unit 182 (step S108: NO).

However, when there is a printing-complete notification from the printer-control unit 182, the system-control unit 192 determines that printing is complete (step S108: YES), and ends processing.

(Step S109)

When it is determined in step S102 that a preceding job cannot be interrupted, the system-control unit 192 gives an instruction to perform normal printing, and moves to step S108.

In this case, when the preceding job is a 1 Sheet Batch, it is not possible to interrupt the preceding job, so after printing of the preceding job is complete, the system-control unit 192 gives an instruction to print the simple job.

The image-forming apparatus of the present disclosure includes a transporting path 150*a* (first transporting path) that passes by the printer unit 120, and a transporting path 150*b* (second transporting path) for moving paper 111, which has been branched off from the transporting path 150*a* (first transporting path) and turned over from front to back, further to the upstream side than the printer unit 120 of the transporting path 150*a* (first transporting path). When an interrupt job is set, presuming that transporting will be performed on the transporting path 150*b* (second transporting path), the system-control unit 192 references the condition table 200 that indicates conditions for preceding jobs that are double-sided printing and that can be interrupted by an interrupt job that is single-sided printing, and when a preceding job can be interrupted, sets the printing order so that printing of the interrupt job is inserted in the printing order of the preceding job. As a result, during processing of a simple job (interrupt job), the paper of the preceding job is positioned on the transporting path 150*b* (second transporting path) side, and after processing of the simple job (interrupt job) is finished, processing of the preceding job can be continued, so it is possible to prevent a drop in the processing speed even when a preceding job is interrupted by a simple job (interrupt job).

In a typical image-forming apparatus, when an interrupting printing instruction is inputted during continuous copying, it is possible to form an image on paper after the printing interrupt by causing the preceding paper that has been printed in the copying process to wait on a paper-refeed transporting path.

Incidentally, in the image-forming apparatus, there is a problem in that image formation on the preceding paper is restarted after the preceding paper is caused to wait on the paper-refeed transporting path, so there is a drop in the processing speed by the amount that the preceding paper was caused to wait.

However, with the image-forming apparatus of the present disclosure, it is possible for processing of the preceding job to continue after processing of the interrupt job is finished, so it is possible to prevent a drop in the processing speed even when a preceding job is interrupted by an interrupt job.

In the present embodiment, the case was explained in which, when interrupt printing by a simple job is set by way of the panel unit 173 and the preceding job can be interrupted, the system-control unit 192 causes the simple job to interrupt the preceding job. Not being limited to this, when a user ID that is included in a simple job is registered in the MFP 100, interrupt processing by that simple job may also be performed preferentially.

What is claimed is:

1. An image-forming apparatus, comprising:

a printer unit that prints on paper:

a first transporting path that passes the printer unit;

a second transporting path that branches off from the first transporting path and moves paper that has been turned over from front to back further upstream than the printer unit of the first transporting path;

a storage unit that stores a condition table that, based on the premise that paper is transported by the second transporting path, indicates conditions for which a preceding job that is double-sided printing can be interrupted by an interrupt job that is single-sided printing; and a system-control unit that when the interrupt printing job is set, references the condition table, and when the preceding job can be interrupted, sets a printing order so that printing of the interrupt job is inserted into the printing order of the preceding job, wherein the system-control unit sets a printing order so that printing of the interrupt job is performed at the timing when the last paper of the preceding printing job is printed on one surface side and is transported on the second transporting path;

the condition table indicates a condition under which the preceding job can be interrupted by the interrupt job for each transporting pattern of paper; and the system-control unit sets a printing order so that, in the transporting pattern, when the number of sheets of printing of the preceding job is less than a first number of sheets that is the number of sheets of paper that can be transported simultaneously on the first transporting path and the second transporting path, printing of the interrupt job is performed within a number of sheets obtained by subtracting the number of sheets of printing of the preceding job from the first number of sheets.

2. The image-forming apparatus according to claim 1, wherein the condition table indicates a condition under which the preceding job can be interrupted by the interrupt job for each transporting pattern of paper; and the system-control unit sets a printing order so that, in the transporting pattern, paper that will not be used for printing of the preceding job is supplied to the first transporting path and printing of the interrupt job is performed after the last paper of the preceding job is printed on one surface side and before the opposite surface side of the first sheet of paper of the preceding job is printed.

* * * * *